US009266320B2

(12) United States Patent
Leader, Jr. et al.

(10) Patent No.: US 9,266,320 B2
(45) Date of Patent: Feb. 23, 2016

(54) METHOD AND APPARATUS FOR MOUNTING A PRINTING PLATE

(75) Inventors: Charles Burleigh Leader, Jr., Napoleon, OH (US); James R. Eddy, Toledo, OH (US); Michael J. Manzella, Toledo, OH (US); David L. Casler, Defiance, OH (US)

(73) Assignee: LEADER ENGINEERING-FABRICATION, INC., Napoleon, OH (US)

( * ) Notice: Subject to any disclaimer, the term of this patent is extended or adjusted under 35 U.S.C. 154(b) by 528 days.

(21) Appl. No.: 13/458,567

(22) Filed: Apr. 27, 2012

(65) Prior Publication Data

US 2012/0272848 A1 Nov. 1, 2012

Related U.S. Application Data

(60) Provisional application No. 61/479,894, filed on Apr. 28, 2011.

(51) Int. Cl.

| | |
|---|---|
| ***B41F 27/00*** | (2006.01) |
| ***B41F 27/12*** | (2006.01) |
| ***B41F 27/08*** | (2006.01) |

(52) U.S. Cl.

CPC ..... *B41F 27/005* (2013.01); *B41F 27/08* (2013.01); *B41P 2227/30* (2013.01); *B41P 2227/41* (2013.01); *B41P 2227/42* (2013.01)

(58) Field of Classification Search

CPC ..... B41F 27/005; B41F 27/06; B41F 27/08; B41F 27/12; B41F 27/12; B41P 2227/30; B41P 2227/41; B41P 2227/42

USPC ..... 101/481, 485, 486, 477, DIG. 36

See application file for complete search history.

(56) References Cited

U.S. PATENT DOCUMENTS

| | | | | |
|---|---|---|---|---|
| 4,872,407 | A * | 10/1989 | Banke | 101/389.1 |
| 5,065,677 | A | 11/1991 | Leader, Jr. | |
| 5,132,911 | A | 7/1992 | Leader, Jr. et al. | |
| 5,485,782 | A | 1/1996 | Van Der Horst | |
| 5,488,781 | A | 2/1996 | Van Der Horst | |
| 5,850,789 | A * | 12/1998 | Rudolf et al. | 101/486 |
| 5,887,523 | A | 3/1999 | Leader, Jr. et al. | |
| 5,969,798 | A | 10/1999 | Nakagawa et al. | |
| 6,055,908 | A | 5/2000 | Van Der Horst | |
| 7,127,993 | B2 | 10/2006 | Otten | |
| 7,971,530 | B2 | 7/2011 | Otten | |
| 2012/0304881 | A1 * | 12/2012 | Otten | 101/481 |

FOREIGN PATENT DOCUMENTS

| | | | | |
|---|---|---|---|---|
| EP | 2532522 | * | 12/2012 | B41F 27/00 |

* cited by examiner

*Primary Examiner* — Matthew G Marini
*Assistant Examiner* — Marissa Ferguson Samreth
(74) *Attorney, Agent, or Firm* — Fraser Clemens Martin & Miller LLC; Jacob M. Ward

(57) ABSTRACT

A method and apparatus for mounting a printing plate onto a printing cylinder, wherein the printing plate includes a first registration mark and a second registration mark centrally located along opposing edges thereof. The apparatus includes an optical system to transmit images of the registration marks to a user interface, wherein a user selects a desired location point location of each of the registration marks displayed on the user interface to facilitate an alignment of the printing plate in respect of a central axis of the printing cylinder.

14 Claims, 16 Drawing Sheets

METHOD AND APPARATUS FOR MOUNTING A PRINTING PLATE

CROSS-REFERENCE OF RELATED APPLICATION

This application claims the benefit of U.S. Provisional Application Ser. No. 61/479,894 filed on Apr. 28, 2011. The entire disclosure of the above-identified application is hereby incorporated herein by reference.

FIELD OF THE INVENTION

The invention relates to a method and apparatus for mounting a printing plate, and more particularly to a method and apparatus for mounting a flexible printing plate on a press cylinder or a flexographic sleeve.

BACKGROUND OF THE INVENTION

In one form of the printing process, printing is effected by photopolymer or rubber printing plates mounted on cylinders or flexographic sleeves, the material to be printed being impressed on the inked printing plate. The cylinder or sleeve on which the printing plates are mounted is generally called the plate or printing cylinder. The quality of a printing job depends, in a large measure, on the care in which pre-press preparations are carried out. Plate-mounting, color registration and proofing are effected off the press by means of commercially available mounting-proofing machines designed for this purpose.

The mounting of photopolymer or other printing plates onto the plate cylinder for printing therefrom requires a high degree of accuracy in the alignment thereof. The image must be straight and in register on the cylinder in order to print straight and in register on the work. In the printing of colors or in the super-impression of images, the various colors or images are added sequentially. Accordingly, it is important that in each case the printing plate which is adding the successive color or image be synchronized with the preceding plate or plates so that the colors or images are accurately superimposed. To arrange these plates in the exact predetermined relation to one another requires that their angular and transverse position on of the printing cylinder as well as their location about a circumference of the printing cylinder be accurately performed. In the prior art, this synchronizing has been performed by manually using mechanical apparatuses which are complicated in their implementation and easily subject to inaccuracies from operator error. In the past, a quality of synchronizing of the printing plates has been realized when they were in position in the printing press. This is not only inconvenient and presents difficult working conditions, but also the printing press is out of operation during this time.

One common method to effect the alignment of the plates with respect to the print cylinder involves the drawing of a line around the print cylinder. This line is then aligned by eye with a longitudinal line along the length of the photopolymer or other print plate. This method is relatively accurate but can be extremely time consuming for the operator. This leads to delay between print runs and is costly with respect to the time lost between such runs.

Alternatively, there is commercially available a device to aid in the alignment of photopolymer or printing plates onto the print cylinder. The print cylinder is placed in a fixed relationship to the device and the plate is laid upside down on a clear glass top. By means of a series of mirrors having lines drawn thereon, the plate is aligned relative to the print cylinder. However, this device is also relatively time consuming and the required accuracy is not achieved. There is only a one-to-one relationship between the eye of the operator and the device assisting in the alignment which can lead to errors of up to one millimeter. These errors are unacceptable where accurate printing is required. This device is generally only acceptable for the alignment of printing plates with respect to one another rather than with respect to the print cylinder. These machines, which usually make use of an optical mounting system, make it possible to mount the plates on plate cylinders to effect exact color registration, a procedure essential to the maintenance of both quality and economy in all flexible plate printing operations.

Another drawback of existing types of mounting machines is their limited capacity to handle printing cylinders of different diameters. With machines of the type heretofore known, the capacity of the machine is restricted to a range of printing cylinder diameters extending from about ninety-five percent of the diameter of the proofing cylinder down to about twenty-five or thirty percent thereof, or approximately four to one. Moreover, since in existing structures the proof forces imposed at contact are eccentrically opposed, the structures required to accommodate these magnified forces are too large to permit smaller sizes of printing cylinders to fit the machine.

Accordingly, it would be desirable to produce an apparatus for mounting a printing plate, wherein the apparatus and a method of operation thereof maximize an accuracy and an efficiency of mounting the printing plate.

SUMMARY OF THE INVENTION

In concordance and agreement with the present invention, an apparatus for mounting a printing plate, wherein the apparatus and a method of operation thereof maximize an accuracy and an efficiency of mounting the printing plate, has surprisingly been discovered.

In an embodiment, an apparatus for mounting a flexible printing plate comprises: a base for supporting a printing cylinder configured to receive at least one flexible printing plate thereon; a control system coupled to the base, the control system having a user interface; and an optical system coupled to the base and in signal communication with the control system, wherein the optical system transmits images of a plurality of registration marks located on the at least one flexible printing plate to be displayed on the user interface, wherein a desired location point of each of the registration marks displayed on the user interface is selectable by a user to facilitate an alignment of the at least one flexible printing plate in respect of a central axis of the printing cylinder.

In another embodiment, a method for mounting a printing plate is disclosed.

The method comprises the steps of: providing a printing cylinder for receiving at least one flexible printing plate thereon, the at least one flexible printing plate having a plurality of registration marks; providing an optical system for viewing images of the registration marks, wherein the optical system transmits the images of the registration marks to a user interface for display; selecting a desired location point of each of the registration marks displayed on the user interface; and aligning the at least one flexible printing plate in respect of a central axis of the printing cylinder based upon the desired location points of the registration marks.

In yet another embodiment, a method for mounting a printing plate comprises the steps of: providing a printing cylinder for receiving at least one flexible printing plate thereon, the at least one flexible printing plate having a first registration mark and a second registration mark; providing an optical system for viewing images of the registration marks, the optical system including a first camera and a second camera; providing a control system having a user interface in communication with the optical system; transmitting an image of the first registration mark from the first camera to the user interface; selecting a desired location point of the first registration mark displayed on the user interface; transmitting an image of the first registration mark from the second camera to the user interface; selecting a desired location point of the first registration mark displayed on the user interface; transmitting an image of the second registration mark from the first camera to the user interface; selecting a desired location point of the second registration mark displayed on the user interface; transmitting an image of the second registration mark from the second camera to the user interface; selecting the desired location point of the second registration mark displayed on the user interface; transmitting an image of the first registration mark from the second camera to the user interface; selecting the desired location point of the first registration mark displayed on the user interface; and aligning the at least one flexible printing plate in respect of a central axis of the printing cylinder based upon the desired location points of the registration marks.

BRIEF DESCRIPTION OF THE DRAWINGS

The above, as well as other advantages of the present disclosure, will become readily apparent to those skilled in the art from the following detailed description, particularly when considered in the light of the drawings described herein.

DETAILED DESCRIPTION OF EXEMPLARY EMBODIMENTS OF THE INVENTION

The following detailed description and appended drawings describe and illustrate various embodiments of the invention. The description and drawings serve to enable one skilled in the art to make and use the invention, and are not intended to limit the scope of the invention in any manner.

FIGS. 1-11 show an apparatus 10 for mounting at least one flexible printing plate 11 (shown in FIGS. 10-11) on a printing cylinder 12 according to an embodiment of the invention. It is understood that the printing cylinder 12 can be any printing cylinder as desired such as a sleeve for use in a flexographic or rotary printing press, for example. The printing cylinder 12 shown includes a sticky adhesive layer which adheres to an outer surface of the printing cylinder 12 and provides an outer surface capable of securely mounting the printing plate 11 thereto. The printing plate 11 includes a first registration mark 13*a* and a second registration mark 13*b* (shown in FIGS. 10-11) formed at a desired location (i.e. a center point of opposing longitudinal edges, a center point of opposing latitudinal edges, opposing corners, etc.) thereof for facilitating a mounting of the printing plate 11 onto the printing cylinder 12. The registration marks 13*a*, 13*b* can be a microdot as is known in the art.

Figure 8:
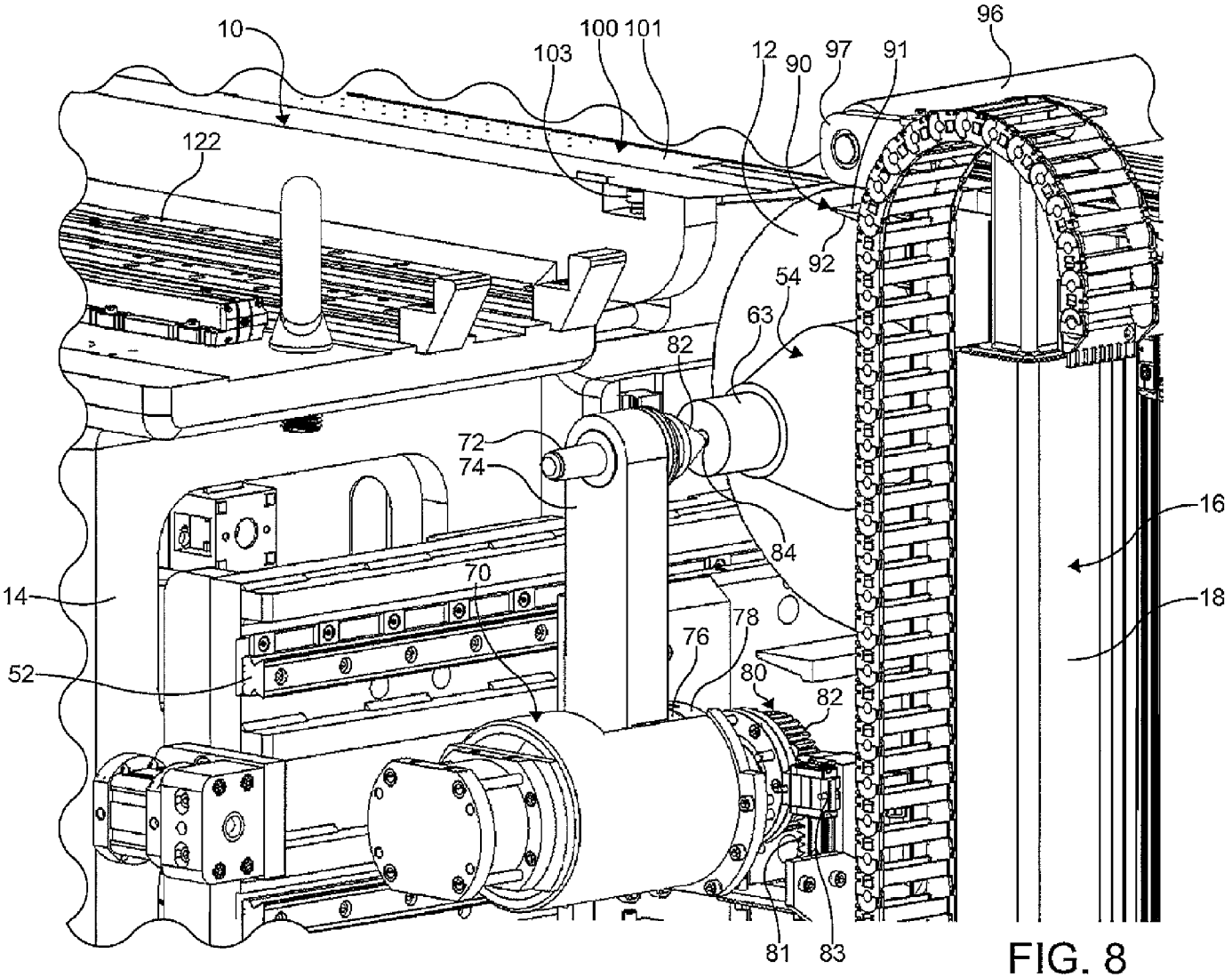
FIG. 8 is an enlarged front perspective view of a portion of the apparatus shown within circle 8 of FIG. 1 having a positioning assembly in an engaged position.

The apparatus 10 includes a generally horizontal base 14 and a support assembly 16 to be mounted on a solid support surface such as a building floor, for example. The support assembly 16 is positioned at a front of the apparatus 10 and includes a pair of generally vertically extending legs 18 positioned at opposite sides of the apparatus 10. A first carrier 50 for receiving and positioning the printing cylinder 12 is located between the support assembly 16 and the base 14. In certain embodiments, the first carrier 50 is movably mounted on tracks or rails 52 coupled to the base 14, as shown in FIG. 8. It is understood, however, that the first carrier 50 can be movably mounted to the base 14 by any means as desired. The rails 52 permit movement of the printing cylinder 12 along an "X" axis and a "Z" axis of the apparatus 10. The "X" axis of the apparatus 10 extends generally parallel to a plane of FIG. 2 and the "Z" axis of the apparatus 10 extends generally perpendicular to a plane of FIG. 6. Accordingly, the printing cylinder 12 can travel in a first or left direction and a second or right direction along the "X" axis and a first or upward direction and a second or downward direction along the "Z" axis. The first carrier 50 rotatably supports an axle 54 (shown in FIGS. 3-4 and 8-9) of the printing cylinder 12. The axle 54 facilitates a rotational movement of the printing cylinder 12 in at least one of a first or clockwise direction and an opposite second or counter-clockwise direction. At least one actuator 60 (shown in FIGS. 1-2 and 5-7) can be employed to cause the axial and rotational movement of the printing cylinder 12. It is understood that the actuator 60 can be any suitable actuator 60 such as a mechanical, an electrical, or an electro-mechanical actuator, for example.

Figure 1:
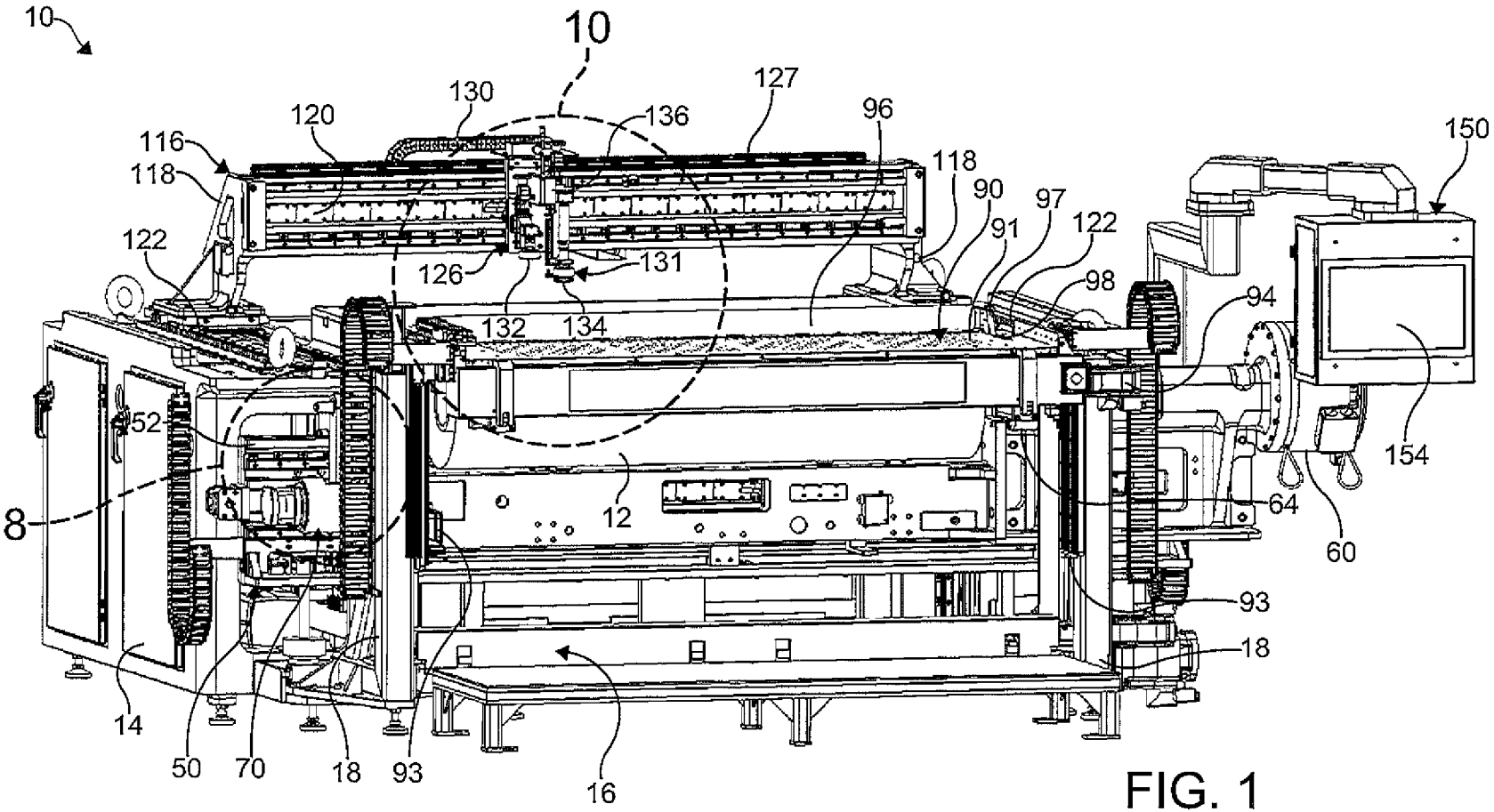
FIG. 1 is a front perspective view of an apparatus for mounting a printing plate according to an embodiment of the invention.
Figure 2:
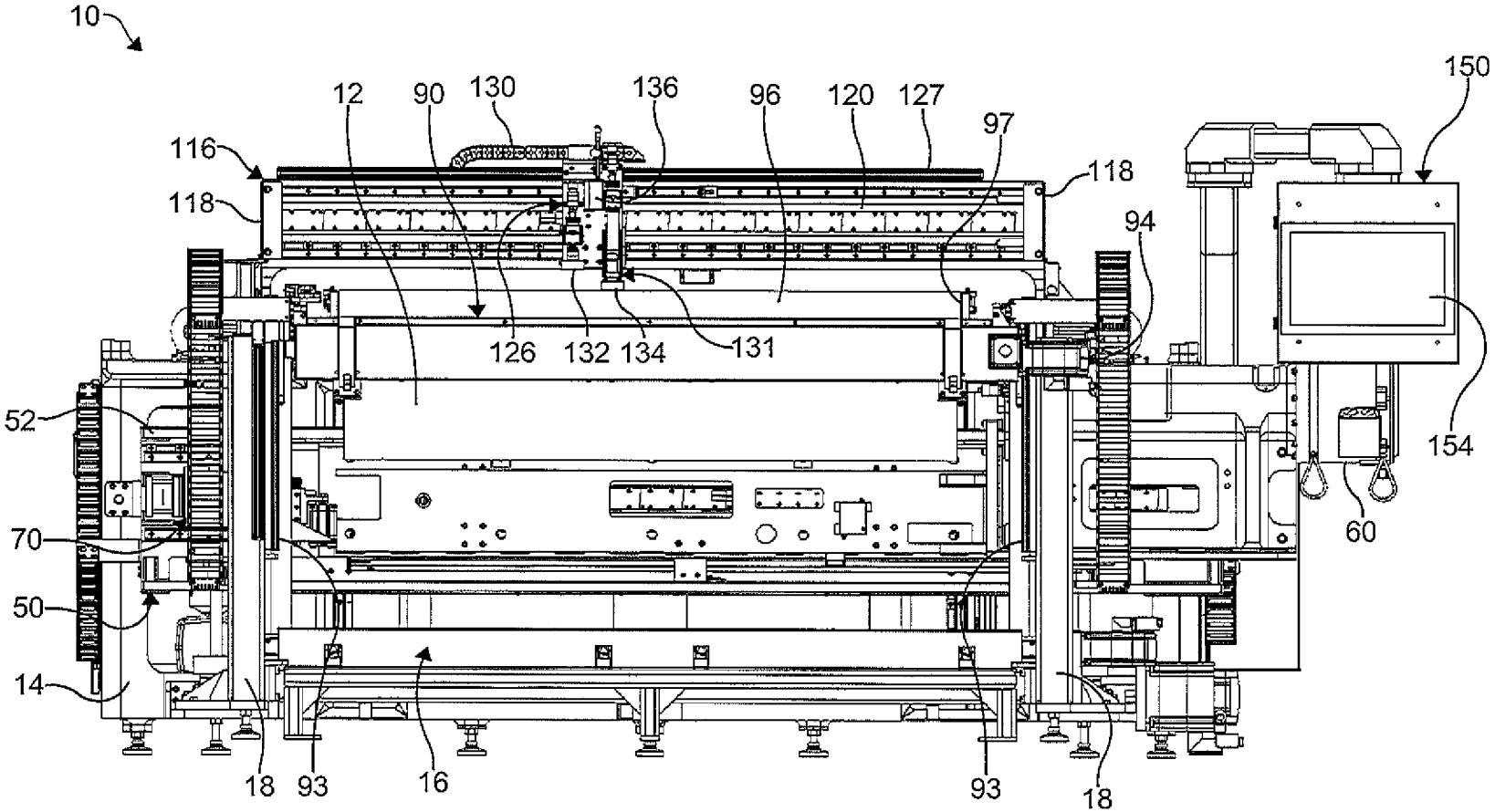
FIG. 2 is a front elevational view of the apparatus illustrated in FIG. 1.
Figure 3:
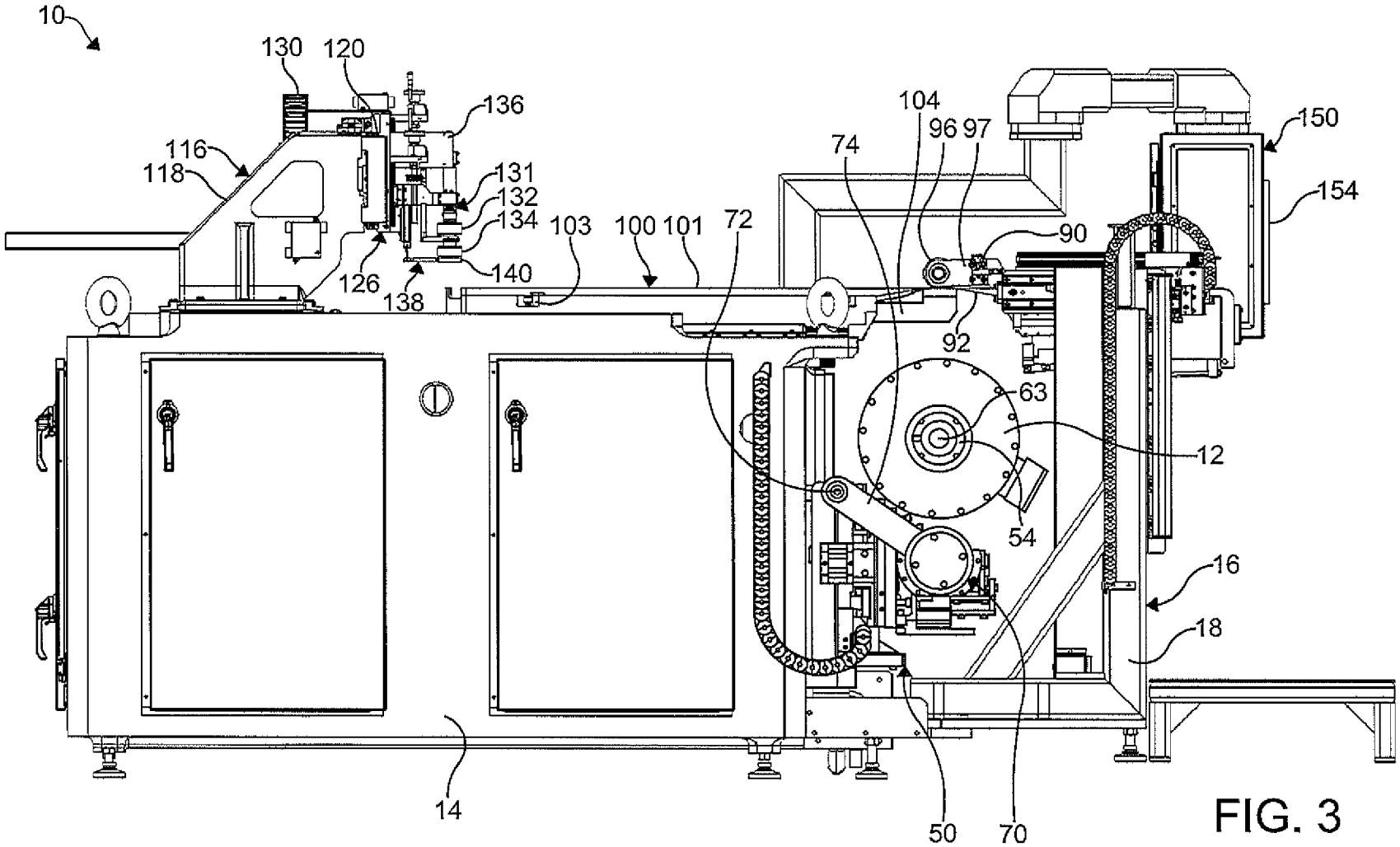
FIG. 3 is a left side elevational view of the apparatus illustrated in FIGS. 1-2 showing a printing cylinder in a first or downward position.
Figure 4:
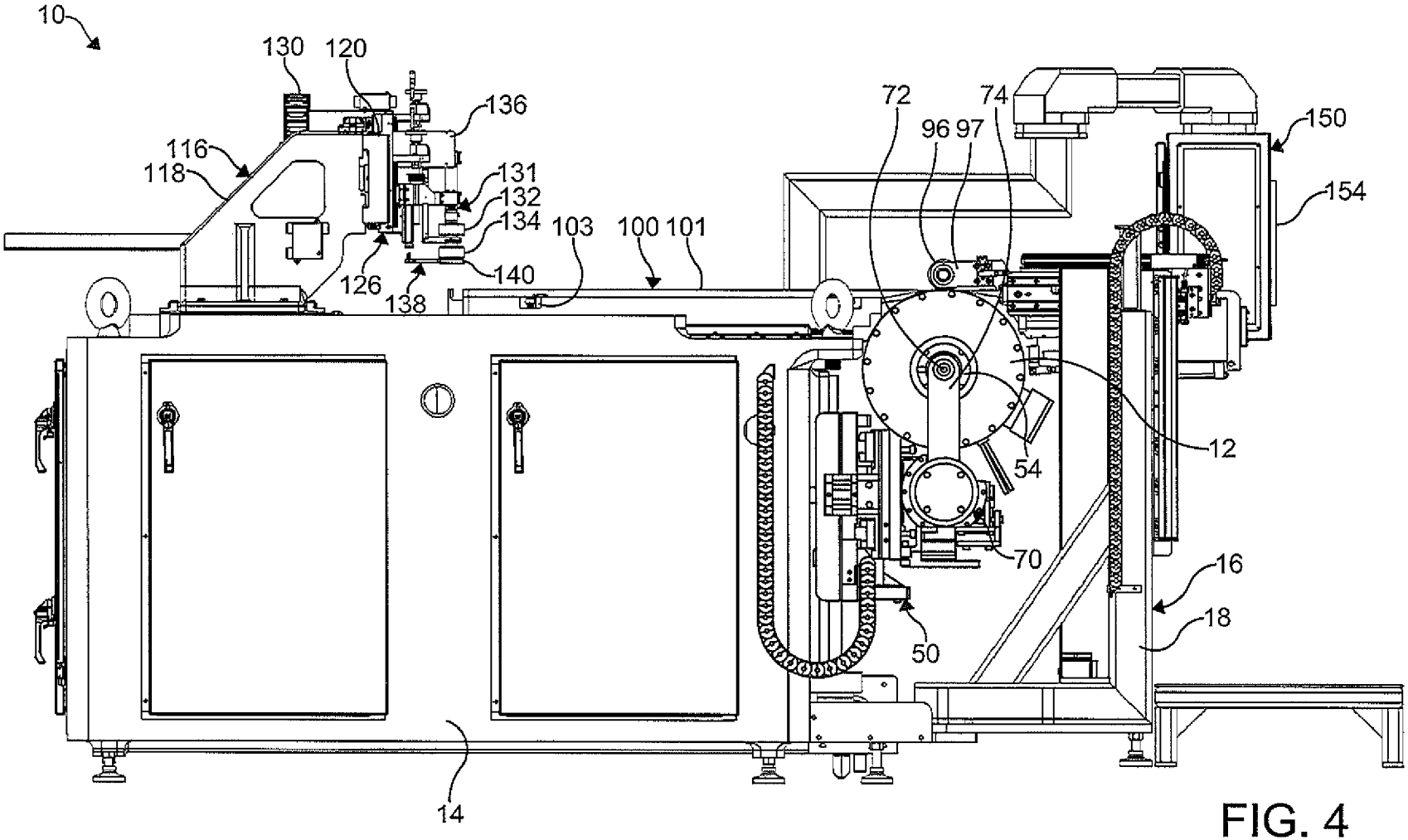
FIG. 4 is a left side elevational view of the apparatus illustrated in FIGS. 1-3 showing the printing cylinder in a second or upward position.
Figure 5:
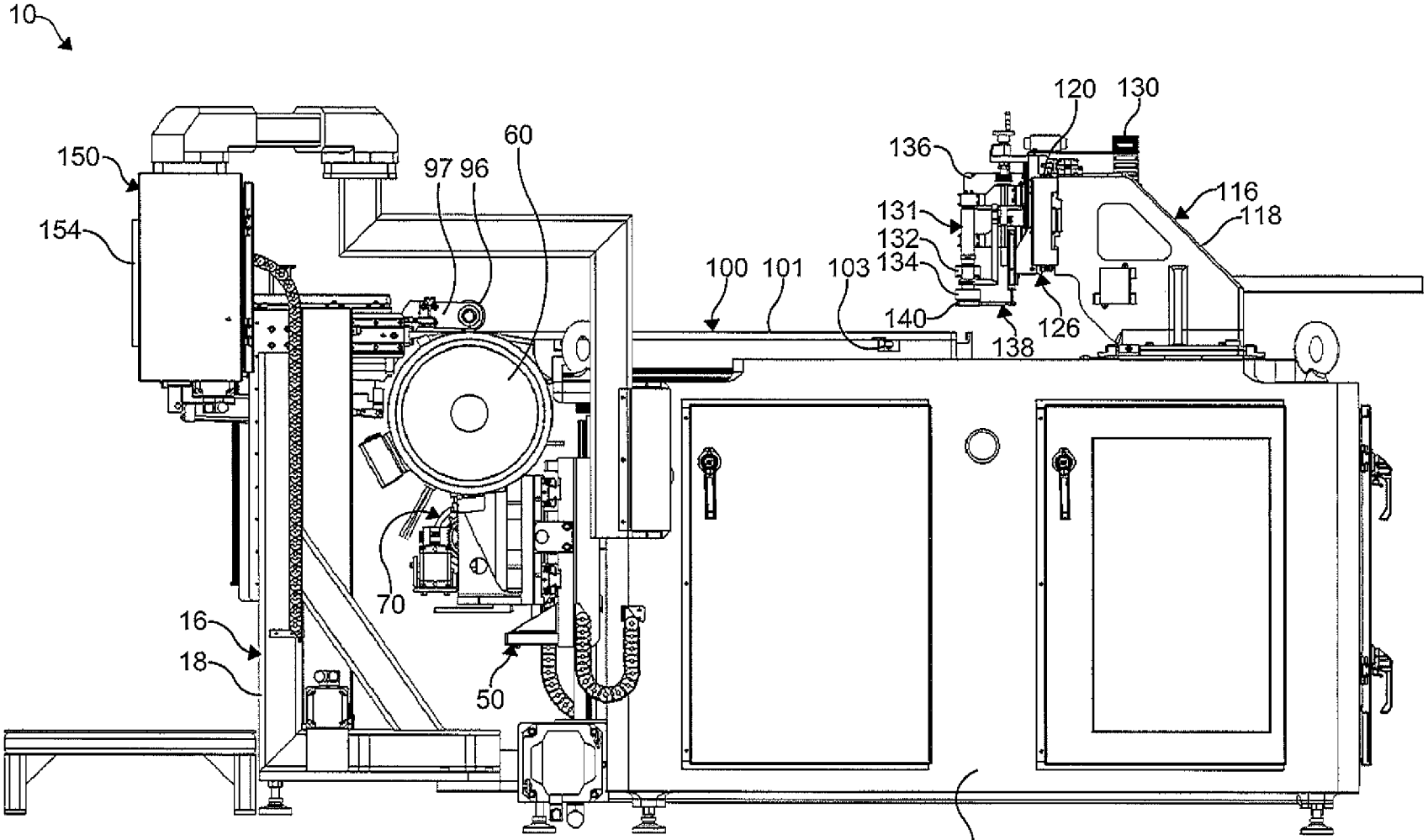
FIG. 5 is a right side elevational view of the apparatus illustrated in FIGS. 1-4 showing the printing cylinder in the second or upward position.
Figure 9:
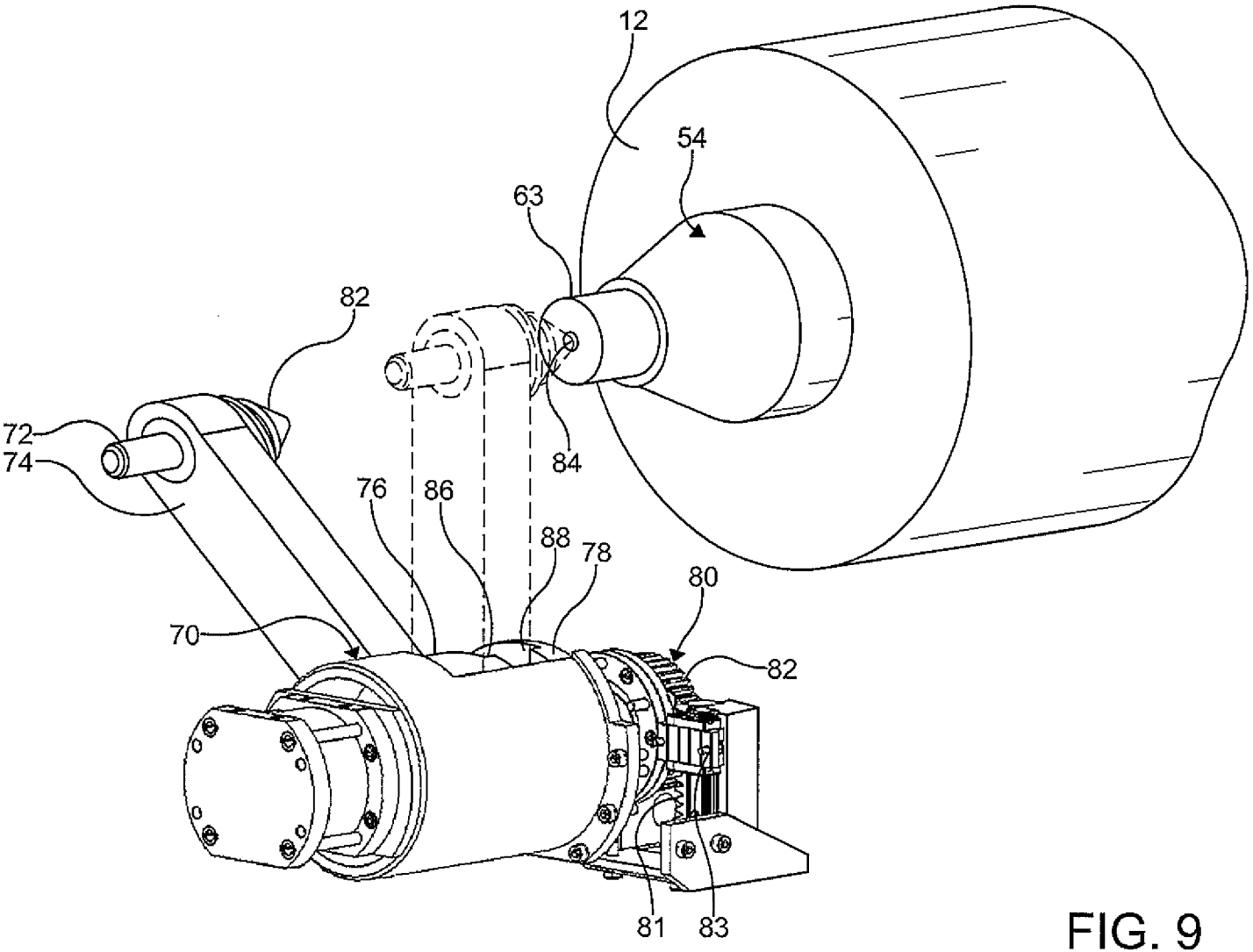
FIG. 9 is a fragmentary front perspective view of the positioning assembly showing a disengaged position of the positioning assembly in solid line and the engaged position thereof in dashed line.

The axle 54 includes a first end (not shown) and an opposing second end 63 (shown in FIGS. 8-9). The first end of the axle 54 is retained by a bearing block 64 (shown in FIGS. 1 and 7) and coupled to the actuator 60. The second end 63 of the axle 54 cooperates with a positioning assembly 70. As shown in solid line in FIGS. 4 and 8 and dashed line in FIG. 9, the positioning assembly 70 can be engaged to locate the printing cylinder 12 in a desired position and maintain the desired position during operation of the apparatus 10. Conversely, the positioning assembly 70 can be disengaged to allow the printing cylinder 12 to be inserted, removed, or replaced, as shown in FIGS. 3 and 9. In certain embodiments, the positioning assembly 70 includes a mandrel 72, a swing arm 74, a first locating block 76, and a second locating block 78. The swing arm 74 is coupled to the mandrel 72 to position the mandrel 72 between a first position, as shown in solid line in FIGS. 3 and 9, and a second position, as shown in solid line in FIG. 8 and dashed line in FIG. 9. In the first position, the mandrel 72 is spaced apart from the axle 54 permitting access to the printing cylinder 12. In the second position, a generally conical shaped end 82 of the mandrel 72 is received in a recess 84 formed in the second end 63 of the axle 54.

The swing arm 74 is also coupled to the first locating block 76 to position the first locating block 76 between a first position, shown in FIG. 9, and a second position, shown in FIG. 8. The first locating block 76 includes an array of spaced apart protuberances 86 formed thereon. The protuberances 86 of the first locating block 76 cooperate with corresponding recesses 88 formed in the second locating block 78. Each of the protuberances 86 and the recesses 88 shown has a generally trapezoidal shape to maintain the accurate positioning of the mandrel 72 and the printing cylinder 12 when surfaces of the protuberances 86 and the recesses 88 begin to wear from use of the apparatus 10. It is understood, however, that the protuberances 86 and the cooperating recesses 88 can have any shape and size as desired.

In the first position, the protuberances 86 are spaced apart from the recesses 88 forming a gap therebetween. In the second position of the first locating block 76, the protuberances 86 are received in the recesses 88 of the second locating block 78. When each of the mandrel 72 and the first locating block 76 is in the first position thereof, the positioning assembly 70 is disengaged. Conversely, when each of the mandrel 72 and the first locating block 76 is in the second position thereof, the positioning assembly 70 is engaged to militate against axial and lateral movement of the printing cylinder 12 during use of the apparatus 10. The swing arm 74 is coupled to an actuator assembly 80, shown in FIGS. 8-9, to cause rotational and axial movement of the swing arm 74. As shown, the actuator assembly 80 includes a rack 81, a pinion 82, and an actuator 83. It is understood that the actuator 83 can be any suitable actuator as desired such as an air cylinder or an electric motor which drives the rack 81 to rotate the pinion 82, for example. It is understood that any means of causing rotational and axial movement of the swing arm 74 can be employed as desired.

A first table 90 is supported by the legs 18 of the support assembly 16. The table 90 has a generally horizontal and substantially planar top surface 91. A rear edge 92 of the table 90 is beveled to permit the table 90 to be positioned adjacent the printing cylinder 12, as shown in FIG. 3. It is understood that the table 90 can be any size and shape as desired.

The table 90 extends across the front of the apparatus 10 along the "X" axis thereof. In certain embodiments, the table 90 is movably mounted on tracks or rails 93 coupled to the legs 18. It is understood, however, that the table 90 can be movably mounted to the legs 18 by any means as desired. The rails 93 permit movement of the table 90 along a "Y" axis and the "Z" axis of the apparatus 10. The "Y" axis of the apparatus 10 extends generally parallel to planes of FIGS. 3-5. Accordingly, the table 90 can travel in a first or forward direction and a second or rearward direction along the "Y" axis, as well as a first or upward direction and a second or downward direction along the "Z" axis. At least one actuator 94 can be employed to cause the movement of the table 90. It is understood that the actuator 94 can be any suitable actuator such as a mechanical, an electrical, or an electro-mechanical actuator, for example.

A roller 96 is rotatably supported at its ends by a pair of spaced apart arms 97. A lower portion of the arms 97 is slideably coupled to a bottom surface of the table 90. Each of the arms 97 extends through a respective slot 98 formed in the table 90. The slots 98 permit movement of the roller 96 in a first or forward direction and a second or rearward direction along the "Y" axis of the apparatus 10. The roller 96 is selectively positionable between a first position and a second position. When the roller 96 is at the first position, the roller 96 is adjacent the table 90 offset from the rear edge 92 thereof. Conversely, when the roller 96 is at the second position, the roller 96 is adjacent the printing cylinder 12. At least one actuator can be employed to cause the movement of the roller 96. It is understood that the actuator can be any suitable actuator such as a mechanical, an electrical, or an electro-mechanical actuator, for example. The roller 96 shown has a generally cylindrical shape having a circular cross-section. It is understood, however, that the roller 96 can have any shape and size as desired.

As illustrated in FIGS. 1 and 3-8, a second table 100 is mounted on a top of the base 14. The table 100 is generally rectangular and has a substantially horizontal and planar top surface 101. A front edge of the table 100 is beveled to permit the table 100 to be positioned adjacent the printing cylinder 12. It is understood that the table 100 can be any size and shape as desired. As shown, the table 100 extends across the top of the base 14 of the apparatus 10 substantially coplanar with and opposite the table 90 forming a space therebetween. The table 100 is movably mounted on bearings 103 coupled to the base 14. At least one wear plate (not shown) may be disposed in a bottom surface of the table 100 adjacent the bearings 103 to militate against damage to the table 100 by the bearings 103. In the embodiment shown, the bearings 103 permit movement of the table 100 along the "X" axis and the "Y" axis of the apparatus 10. It is understood that the bearings 96 can also permit a rotational movement of the table 100. Accordingly, the table 100 can travel in a first or left direction and a second or right direction along the "X" axis, as well as a first or forward direction and a second or rearward direction along the "Y" axis. At least one actuator (not shown) can be employed to cause the movement of the table 100. It is understood that the actuator can be any suitable actuator such as a mechanical, an electrical, or an electro-mechanical actuator, for example. In the embodiment shown, the actuator is mounted underneath the table 100 within the base 14. It is understood that the actuator can be mounted elsewhere as desired.

Figure 10:
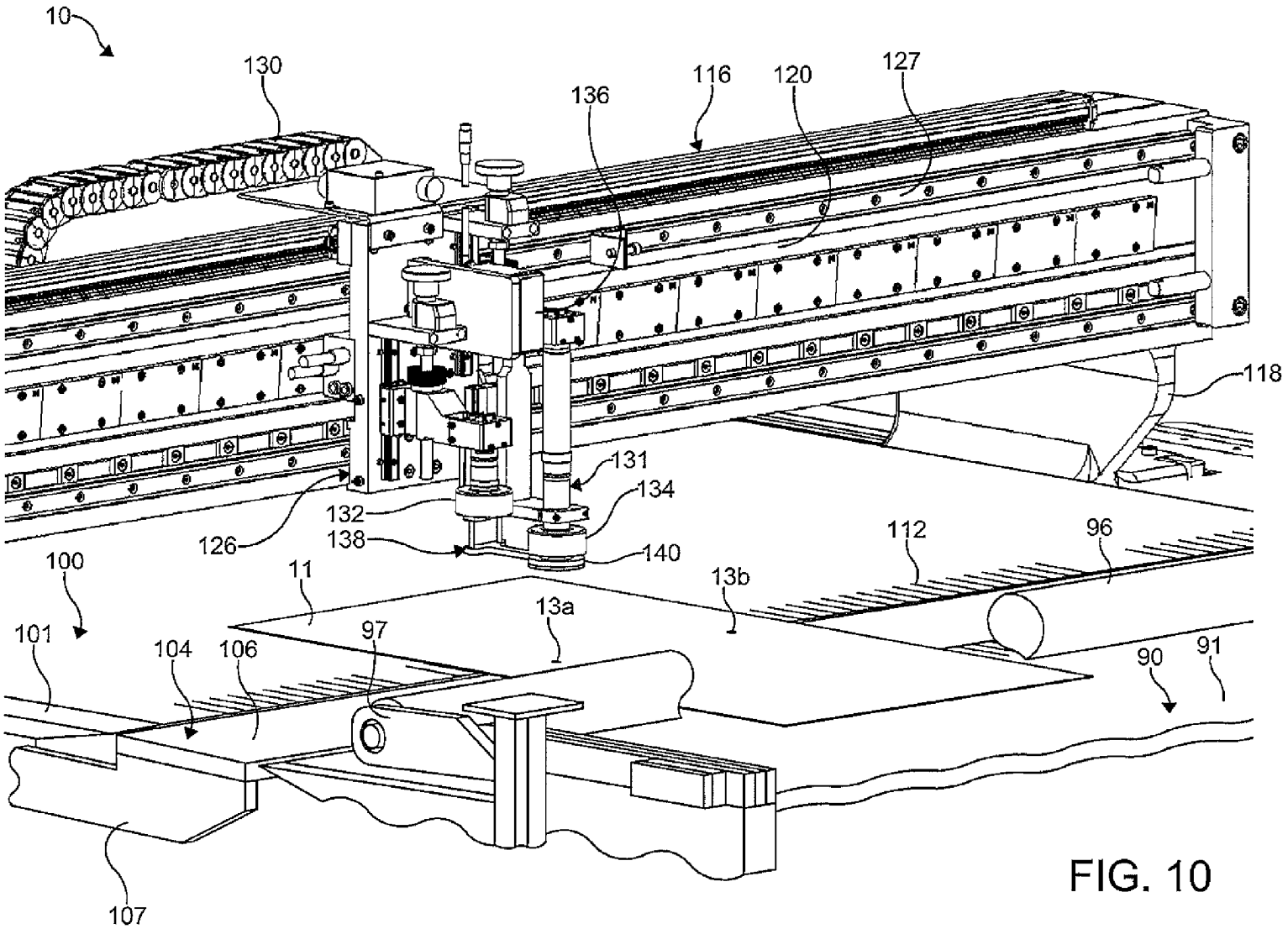
FIG. 10 is an enlarged fragmentary front perspective view of a portion of the apparatus shown within circle 10 of FIG. 1 having a holding device in a first or retracted position.
Figure 11:
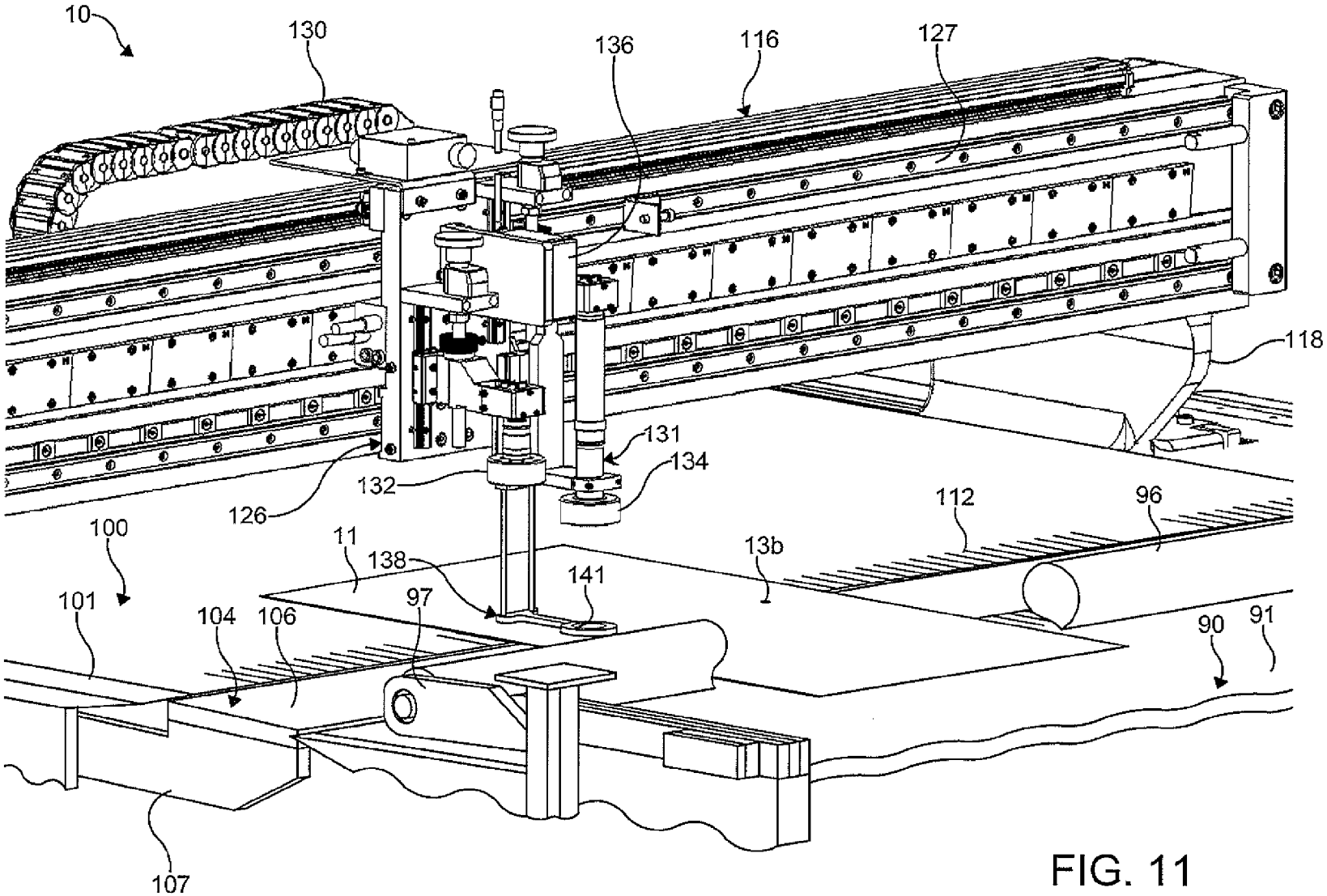
FIG. 11 is an enlarged fragmentary front perspective view of the portion of the apparatus shown within circle 10 of FIG. 1 having the holding device in a second or extended position.

As illustrated in FIGS. 3 and 10-11, a third table 104 is disposed in the space formed between the tables 90, 100. The table 104 is generally rectangular and has a substantially horizontal and planar top surface 106. It is understood that the table 104 can be any size and shape as desired. The table 104 is supported at its ends by a pair of spaced apart arms 107. A lower portion of the arms 107 is slideably coupled to the top surface of the base 14. The arms 107 permit movement of the table 104 in a first or forward direction and a second or rearward direction along the "Y" axis of the apparatus. The table 104 is selectively positionable between a first position and a second position. When the table 104 is at the first position, the table 104 is positioned in between the tables 90, 100. Conversely, when the table 104 is at the second position, the table 104 is underneath the table 100 to open the space between the tables 90, 100. At least one actuator (not shown) can be employed to cause the movement of the table 104. It is understood that the actuator can be any suitable actuator such as a mechanical, an electrical, or an electro-mechanical actuator, for example.

Figure 6:
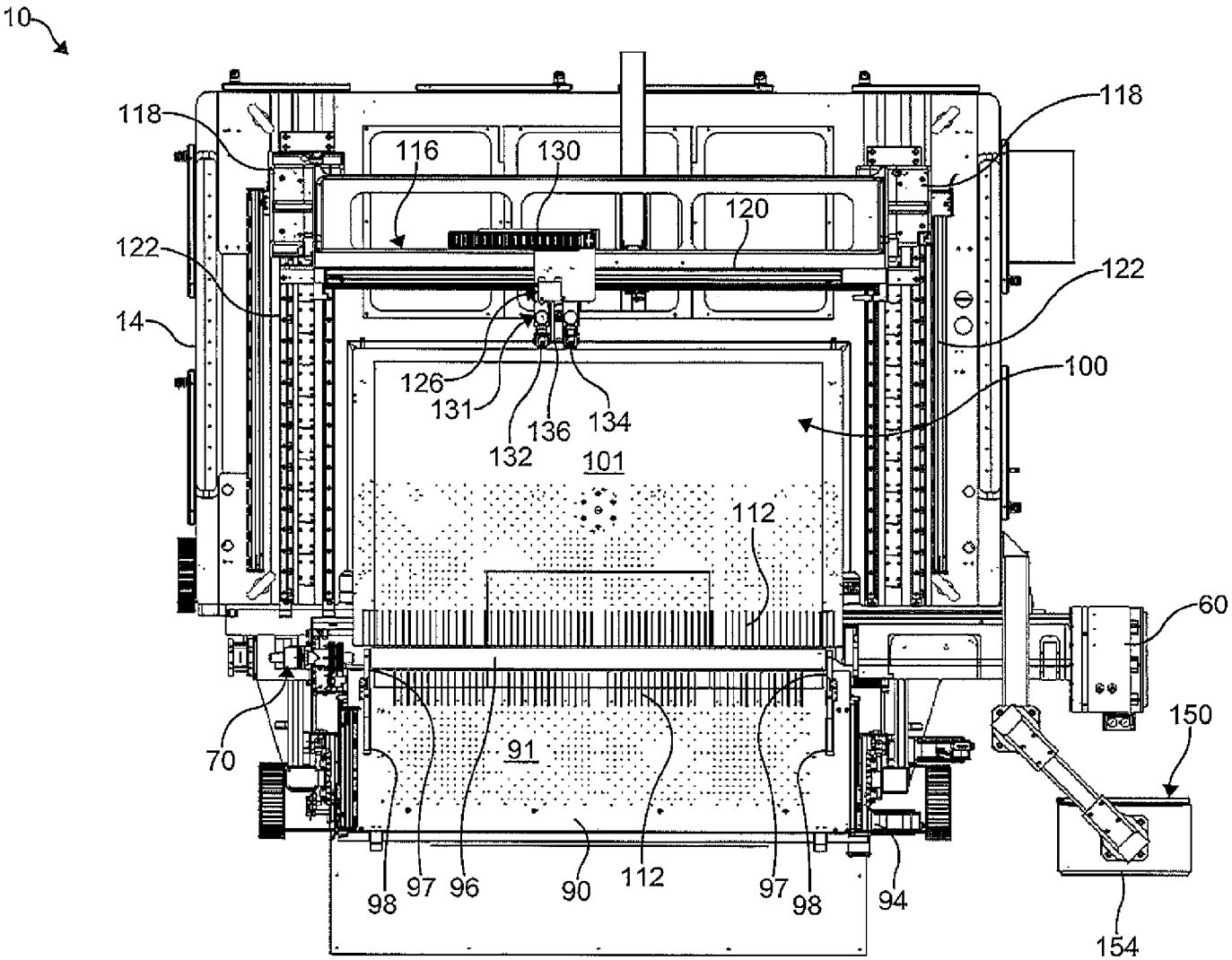
FIG. 6 is a top plan view of the apparatus illustrated in FIGS. 1-5.
Figure 7:
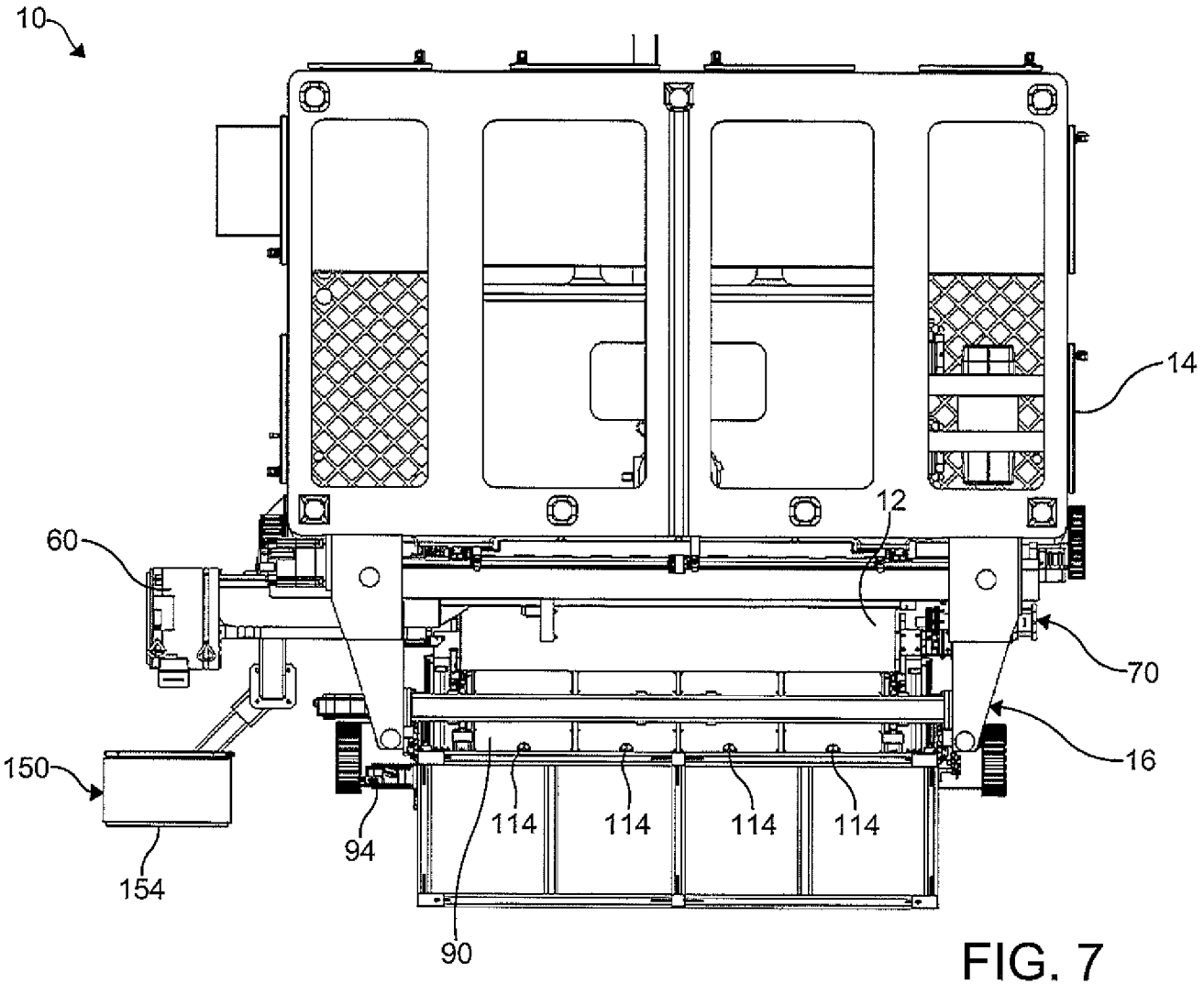
FIG. 7 is a bottom plan view of the apparatus illustrated in FIGS. 1-6.

As shown in FIGS. 6 and 10-11, each of the tables 90, 100, 104 may be provided with a plurality of slits 112. The slits 112 are in fluid communication with a plurality of ports 114 shown in FIG. 7. Each of the ports 114 is coupled to a source of vacuum through a conduit (not shown). When the printing plate 11 is placed on the top surfaces 91, 101, 106 of the respective tables 90, 100, 104, a vacuum is applied to the printing plate 11. The vacuum firmly holds the printing plate 11 in place to militate against a movement thereof relative to the tables 90, 100, 104. It is understood that a plurality of vacuum zones can be produced by selectively controlling the vacuum applied to the printing plate 11 through at least one the ports 114. The vacuum zones can be controlled, individually or in combination, to apply the vacuum to the printing plate 11.

A second carrier 116 is positioned at a top of the apparatus 10 and includes a pair of generally vertically extending legs 118. The legs 118 are positioned at opposite sides of the apparatus 10 to support a bridge member 120. In certain embodiments, the second carrier 116 is movably mounted on tracks or rails 122 coupled to the base 14. It is understood, however, that the second carrier 116 can be movably mounted to the base 114 by any means as desired. The rails 122 permit movement of the bridge member 120 along the "Y" axis of the apparatus 10. Accordingly, the bridge member 120 can travel in a first or forward direction and a second or rearward direction along the "Y" axis of the apparatus.

Mounted on the bridge member 120 is an instrument carriage 126. In certain embodiments, the instrument carriage 126 is movably mounted on tracks or rails 127 coupled to the bridge member 120. It is understood, however, that the instrument carriage 126 can be movably mounted to the bridge member 120 by any means as desired. The instrument carriage 126 is moveable in respect of the bridge member 120 along the "X" axis of the apparatus 10. At least one actuator 130 can be employed to cause the movement of the bridge member 120 and the instrument carriage 126. It is understood that the actuator 130 can be any suitable actuator 130 such as a mechanical, an electrical, or an electro-mechanical actuator, for example.

An optical system 131 is mounted on the instrument carriage 126. The optical system 131 includes a first camera 132, a second camera 134, and a reader head 136 emitting a light beam. The cameras 132, 134 and the reader head 136 are directed downwardly toward at least one of the top surfaces 91, 101, 106 of the respective tables 90, 100, 104. It is understood that the cameras 132, 134 can be any suitable cameras and the reader head 136 can be any suitable reader head 136 such as an optical digital micrometer or a displacement measuring laser, for example. The first camera 132 has a wide angle lens to provide a wider angle of view than an angle of view of the second camera 134. As shown in FIGS. 3-5 and 10-11, the instrument carriage 126 further includes a holding device 138 coupled to the second camera 134. It is understood that the holding device 138 or another holding device can be coupled to the first camera 132 if desired. The holding device 138 is positionable between a first or retracted position, shown in FIGS. 3-5 and 10, and a second or extended position, as shown in FIG. 11. In the extended position, a foot portion 140 of the holding device 138 contacts an upper surface of the printing plate 11. The foot portion 140 includes a central aperture 141 formed therein to permit the second camera 134 to view the registration marks 13*a*, 13*b* on the printing plate 11.

As illustrated in FIGS. 1-7, the apparatus 10 further includes a control system 150. The control system 150 includes a programmable controller (not shown) connected to control all of the actuators, the cameras 132, 134, and the reader head 136. Thus, the controller generates control signals to control movement of the tables 90, 100, 104, the roller 96, the first carrier 50, the positioning assembly 70, the second carrier 116, the instrument carriage 126, the cameras 132,134, the reader head 136, and the printing cylinder 12. The control system 150 further includes a user interface 154 such as a touch screen, for example, in electrical communication with the controller. The user interface 154 permits the user to enter inputs such as a location of the registration marks 13*a*, 13*b* of the printing plate 11, a zoom command, a size of the printing cylinder 12, and the like, for example. It is understood that the user can enter the input using any input device as desired such as by a touch panel, a keyboard, a mouse, a joystick, or the like, for example.

A method of operation of the apparatus 10 includes loading the printing cylinder 12 into the first carrier 50 such that the first end of the axle 54 is retained by the bearing block 64 and the second end 63 of the axle 54 cooperates with the positioning assembly 70. The positioning assembly 70 is then engaged to locate the printing cylinder 12 in a desired position and maintain the desired position during operation of the apparatus 10. Specifically, the mandrel 72 of the positioning assembly 70 is moved from the first position to the second position to cause the conical shaped end 82 of the mandrel 72 to be received in the recess 84 formed in the second end 63 of the axle 54. Once the printing cylinder 12 is loaded in the apparatus 10, the controller of the control system 150 verifies the printing cylinder 12 and a size thereof using a measuring ability of the reader head 136. The third table 104 is then positioned in the space between the first table 90 and the second table 100. Thereafter, the roller 96 is moved in a forward direction to the first position. The printing plate 11 is then located by the user on at least one of the tables 90, 100, 104 such that the first registration mark 13*a* of the printing plate 11 is substantially aligned with a light beam emitted from the reader head 136 and the second registration mark 13*b* is as close to aligned with the first registration mark 13*a* with respect to the "X" axis of the apparatus 10. A vacuum is then applied to the printing plate 11 to secure the printing plate 11 to the at least one of the tables 90, 100, 104.

The first camera 132 transmits a signal to the controller and a wide angle view of the first registration mark 13*a* is displayed on the user interface 154. The user then selects a desired location point (i.e. a center) of the first registration mark 13*a* displayed on the user interface 154. It is understood that the user can select the desired location point of the first registration mark 13*a* using any input device as desired such as a touch panel, a keyboard, a mouse, a joystick, or the like, for example. Once the desired location point is selected, the second carrier 116 including the instrument carriage 126 is caused to move such that the second camera 134 is directly above the first registration mark 13*a*. The holding device 138 is then positioned in the extended position having the foot portion 140 contact the printing plate 11. The second camera 134 transmits a signal to the controller and a close-up view of the first registration mark 13*a* is displayed on the user interface 154. The user then selects a desired location point (i.e. a center) of the first registration mark 13*a* displayed on the user interface 154. It is understood that the user can select the desired location point of the first registration mark 13*a* using any input device as desired such as a touch panel, a keyboard, a mouse, a joystick, or the like, for example. Once the desired location point is selected, the holding device 138 is positioned in the retracted position.

The instrument carriage 126 is then caused to move along the "X" axis of the apparatus 10 such that the first camera 132 is directly above the second registration mark 13*b*. The first camera 132 transmits a signal to the controller and a wide angle view of the second registration mark 13*b* is displayed on the user interface 154. The user then selects a desired location point (i.e. a center) of the second registration mark 13*b* displayed on the user interface 154. It is understood that the user can select the desired location point of the second registration mark 13*b* using any input device as desired such as a touch panel, a keyboard, a mouse, a joystick, or the like, for example. The user can repeat the step of selecting the desired location point of the second registration mark 13*b* displayed on the user interface 154 until a desired location of the desired location point is selected.

Once the desired location of the desired location point of the second registration mark 13*b* is selected, the instrument carriage 126 is caused to move along the "X" axis of the apparatus 10 such that the second camera 134 is directly above the second registration mark 13*b*. The holding device 138 is then positioned in the extended position having the foot portion 140 contact the printing plate 11. The second camera 134 transmits a signal to the controller and a close-up view of the second registration mark 13*b* is displayed on the user interface 154. The user then selects a desired location point (i.e. a center) of the second registration mark 13*b* displayed on the user interface 154. It is understood that the user can select the desired location point of the second registration mark 13*b* using any input device as desired such as a touch panel, a keyboard, a mouse, a joystick, or the like, for example. Once the desired location point is selected, the holding device 138 is positioned in the retracted position. The user can repeat the step of selecting the desired location point of the second registration mark 13*b* displayed on the user interface 154 until a desired location of the desired location point is selected.

Once the desired location points of the registration marks 13*a*, 13*b* are selected by the user using the user interface 154, the printing plate 11 is aligned in respect of the printing cylinder 12. In certain embodiments, the printing plate 11 is aligned by a rotational movement and/or axial movement of the table 100 along the "X" axis and the "Y" axis of the apparatus 10 such that the registration marks 13*a*, 13*b* are substantially parallel to a central axis of the printing cylinder 12.

Once the printing plate 11 is aligned in respect of the printing cylinder 12, the instrument carriage 126 moves along the "X" axis of the apparatus 10 such that the second camera 134 is directly above the first registration mark 13*b*. The holding device 138 is then positioned in the extended position having the foot portion 140 contact the printing plate 11. The second camera 134 transmits a signal to the controller and a close-up view of the first registration mark 13*a* is displayed on the user interface 154. The user then checks the location of the desired location point of the first registration mark 13*a* displayed on the user interface 154. The user then selects a desired location point of the first registration mark 13*a* displayed on the user interface 154. Once the desired location point is selected, the holding device 138 is positioned in the retracted position.

The instrument carriage 126 is caused to move along the "X" axis of the apparatus 10 such that the second camera 134 is directly above the second registration mark 13*b*. The holding device 138 is then positioned in the extended position having the foot portion 140 contact the printing plate 11. The second camera 134 transmits a signal to the controller and a close-up view of the second registration mark 13*b* is displayed on the user interface 154. The user then checks the location of the desired location point of the second registration mark 13*b* displayed on the user interface 154. The user then selects a desired location point of the second registration mark 13*b* displayed on the user interface 154. Once the desired location point is selected, the holding device 138 is positioned in the retracted position. The controller then calculates a variance in an alignment of the registration marks 13*a*, 13*b* in an "X" direction and a "Y" direction with respect to the central axis of the printing cylinder 12. The variance in the alignment of the registration marks 13*a*, 13*b* in the "X" direction and the "Y" direction are displayed on the user interface 154 to permit the user to determine whether the printing plate 11 was suitably aligned in respect of the printing cylinder 12.

If the printing plate 11 was not suitably aligned, the user can repeat the above steps of selecting the desired location point of the registration marks 13*a*, 13*b* and aligning the printing plate 11 until a desired alignment of the printing plate 11 is obtained.

Once the printing plate 11 is suitably aligned in respect of the printing cylinder 12, the table 104 is then caused to be moved to expose the space between the tables 90, 100. The printing cylinder 12 is then driven along the "Y" axis of the apparatus 10 in an upward direction to contact the printing plate 11. Once the printing cylinder 12 contacts the printing plate 11, the roller 96 is caused to move from the first position to the second position adjacent an apex of the printing cylinder 12.

The roller 96 contacts the printing plate 11 to cause a central portion of the printing plate 11 to adhere to the printing cylinder 12. The roller 96 and the table 90 are then caused to move in a substantially arcuate path around a circumference of the printing cylinder 12 to a leading edge of the printing plate 11, thereby causing a first half of the printing plate 11 to adhere to the printing cylinder 12. The roller 96 and the table 90 are then caused to move away from the printing cylinder 12 and return to a position where the roller 96 is in contact with the central portion of the printing plate 11 adhered to the printing cylinder 12. The printing cylinder 12 then rotates in the first direction, thereby causing the second half of the printing plate 11 to adhere to the printing cylinder 12. Once the complete printing plate 11 is adhered to the printing cylinder 12, the table 90 and the roller 96 are positioned away from the printing cylinder 12. Thereafter, the printing cylinder 12 is rotated in the second direction until the registration marks 13*a*, 13*b* are located at the apex of the printing cylinder 12.

Once the registration marks 13*a*, 13*b* are located at the apex of the printing cylinder 12, the second carrier 116 and/or the instrument carriage 126 move such that the second camera 134 is directly above the first registration mark 13*a*. The holding device 138 is then positioned in the extended position having the foot portion 140 contact the printing plate 11. The second camera 134 transmits a signal to the controller and a close-up view of the first registration mark 13*a* is displayed on the user interface 154. The user then checks the location of the desired location point of the first registration mark 13*a* displayed on the user interface 154. The user then selects a desired location point of the first registration mark 13*a* displayed on the user interface 154. Once the desired location point is selected, the holding device 138 is positioned in the retracted position. The second carrier 116 and/or the instrument carriage 126 are then caused to move along the "X" axis of the apparatus 10 such that the second camera 134 is directly above the second registration mark 13*b*. The user then checks the location of the desired location point of the second registration mark 13*b* displayed on the user interface 154. The user then selects a desired location point of the second registration mark 13*b* displayed on the user interface 154. Once the desired location point is selected, the holding device 138 is positioned in the retracted position. The controller then calculates a variance in an alignment of the registration marks 13*a*, 13*b* in an "X" direction and a "Y" direction with respect to the central axis of the printing cylinder 12. The variance in the alignment of the registration marks 13*a*, 13*b* in the "X" direction and the "Y" direction are displayed on the user interface 154 to permit the user to determine whether the printing plate 11 was suitably mounted on the printing cylinder 12.

The steps described hereinabove can be repeated for additional printing plates 11 if desired or to realign the printing plate 11 already mounted on the printing cylinder 12. When a mounting of the printing plates 11 is complete, the printing cylinder 12 is moved along the "Z" axis of the apparatus 10 in a downward direction to the first position and the table 90 is moved along the "Y" axis of the apparatus 10 in a forward direction to allow the printing cylinder 12 to be removed and/or replaced. Thereafter, the positioning assembly 70 is disengaged from the printing cylinder 12. Specifically, the mandrel 72 of the positioning assembly 70 is moved from the second position to the first position to cause the conical shaped end 82 of the mandrel 72 to move away from the second end 63 of the axle 54. Thereafter, the printing cylinder 12 having the desired printing plates 11 disposed thereon is unloaded from the apparatus 10.

FIGS. 12-16 show an apparatus 200 for mounting at least one flexible printing plate 11 on a printing cylinder 212 according to another embodiment of the invention. Details as to the printing plate 11 are as described hereinabove for FIGS. 1-11. It is understood that the printing cylinder 212 can be any printing cylinder as desired such as a sleeve for use in a flexographic or rotary printing press, for example. The printing cylinder 212 shown includes a sticky adhesive layer which adheres to an outer surface of the printing cylinder 212 and provides an outer surface capable of securely mounting the printing plate 11 thereto.

The apparatus 200 includes a generally horizontal base 214 to be mounted on a solid support surface such as a building floor, for example. A pair of spaced apart, generally L-shaped first carriers 250 for receiving and positioning the printing cylinder 212 is located in front of and on opposite sides of the base 214. As illustrated in dashed line in FIGS. 12-15, the first carriers 250 support opposite ends 258, 260 of an axle 262 of the printing cylinder 212. In certain embodiment, each of the first carriers 250 is movably mounted on tracks or rails 252 coupled to the base 214 and tracks or rails 254 mounted to the solid support surface. It is understood, however, that the first carriers 250 can be movable mounted to the base 214 and the solid support surface by any means as desired. The rails 252, 254 permit movement of the printing cylinder along a "Y" axis of the apparatus 200 between a first or forward position (shown in dashed line in FIG. 13) and a second or rearward position (shown in solid line in FIG. 13). The "Y" axis of the apparatus 200 extends generally parallel to a plane of FIG. 13. At least one actuator 256 (shown in FIG. 1) can be employed to cause the movement of the first carriers 250. It is understood that the actuators 256 can be any suitable actuators as desired such as a mechanical, an electrical, or an electro-mechanical actuator, for example.

The apparatus 200 further includes a pair of spaced apart second carriers 264 for receiving and positioning the printing cylinder 212. Each of the carriers 264 shown has a generally arcuate-shaped arm 266 extending laterally outwardly therefrom. The arms 266 receive a portion of the axle 262 thereon and rotatably support the printing cylinder 212. In certain embodiments, the second carriers 264 are movably mounted on tracks or rails 268 coupled to the base 214. It is understood, however, that the second carriers 264 can be movably mounted to the base 214 by any means as desired. The rails 268 permit movement of the printing cylinder 212 along a "Z" axis of the apparatus 200 between a first or downward position (shown in FIG. 13) and a second or upward position (shown in FIG. 14). The "Z" axis of the apparatus 200 extends generally perpendicular to a plane of FIG. 14. Accordingly, the printing cylinder 212 can travel in a first or upward direction and a second or downward direction along the "Z" axis. At least one actuator 270 (shown in FIG. 1) can be employed to cause the movement of the second carriers 264. It is understood that the actuators 270 can be any suitable actuators as desired such as a mechanical, an electrical, or an electro-mechanical actuator, for example. At least one of the second carriers 264 may include at least one sensor (not shown) to determine a diameter and a radial position of the printing cylinder 212. It is understood that the sensor can detect any suitable identifier associated with the printing cylinder 212 to determine the radial position of the printing cylinder 212 such as a certain structural characteristic of the printing cylinder 212 (i.e. a key slot) or a specific position locator (i.e. a indicator hole or mark, a identity tag, etc.), for example.

Figure 12:
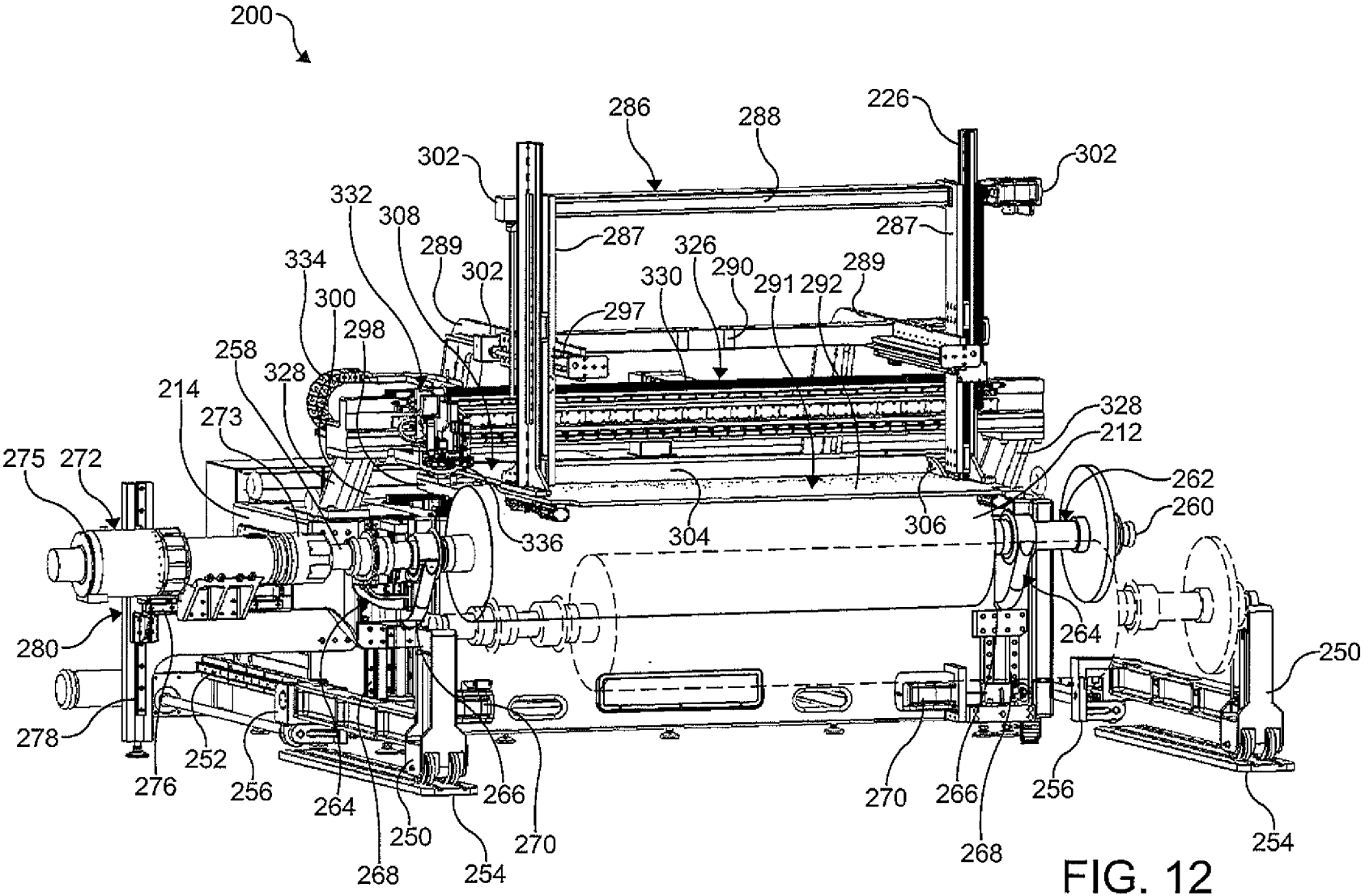
FIG. 12 is a front perspective view of an apparatus for mounting a printing plate according to another embodiment of the invention showing a forward position of a printing cylinder in dashed line and a rearward position thereof in solid line.
Figure 14:
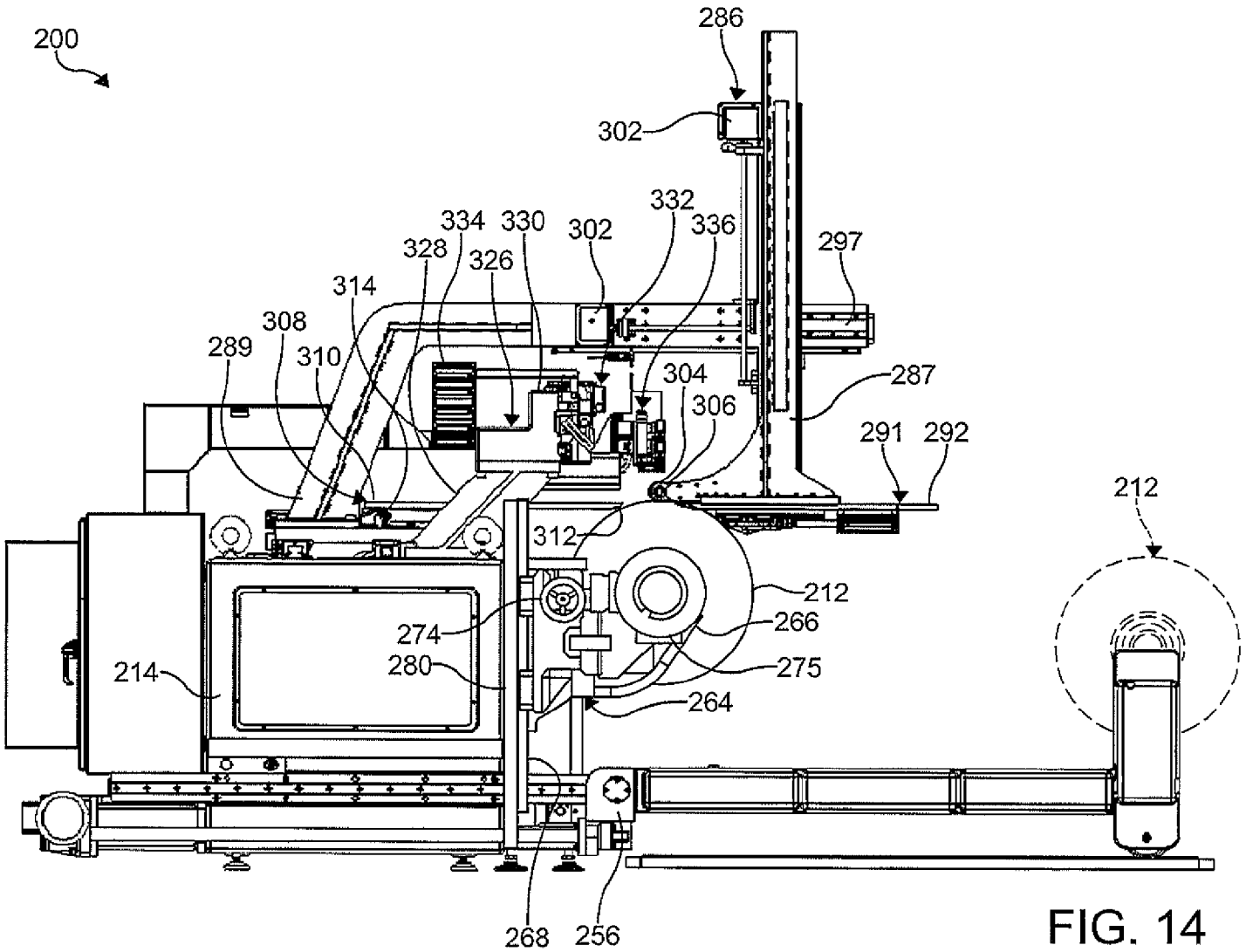
FIG. 14 is a left side elevation view of the apparatus illustrated in FIGS. 12-13 showing a forward position of a printing cylinder in dashed line and an upward position thereof in solid line.
Figure 15:
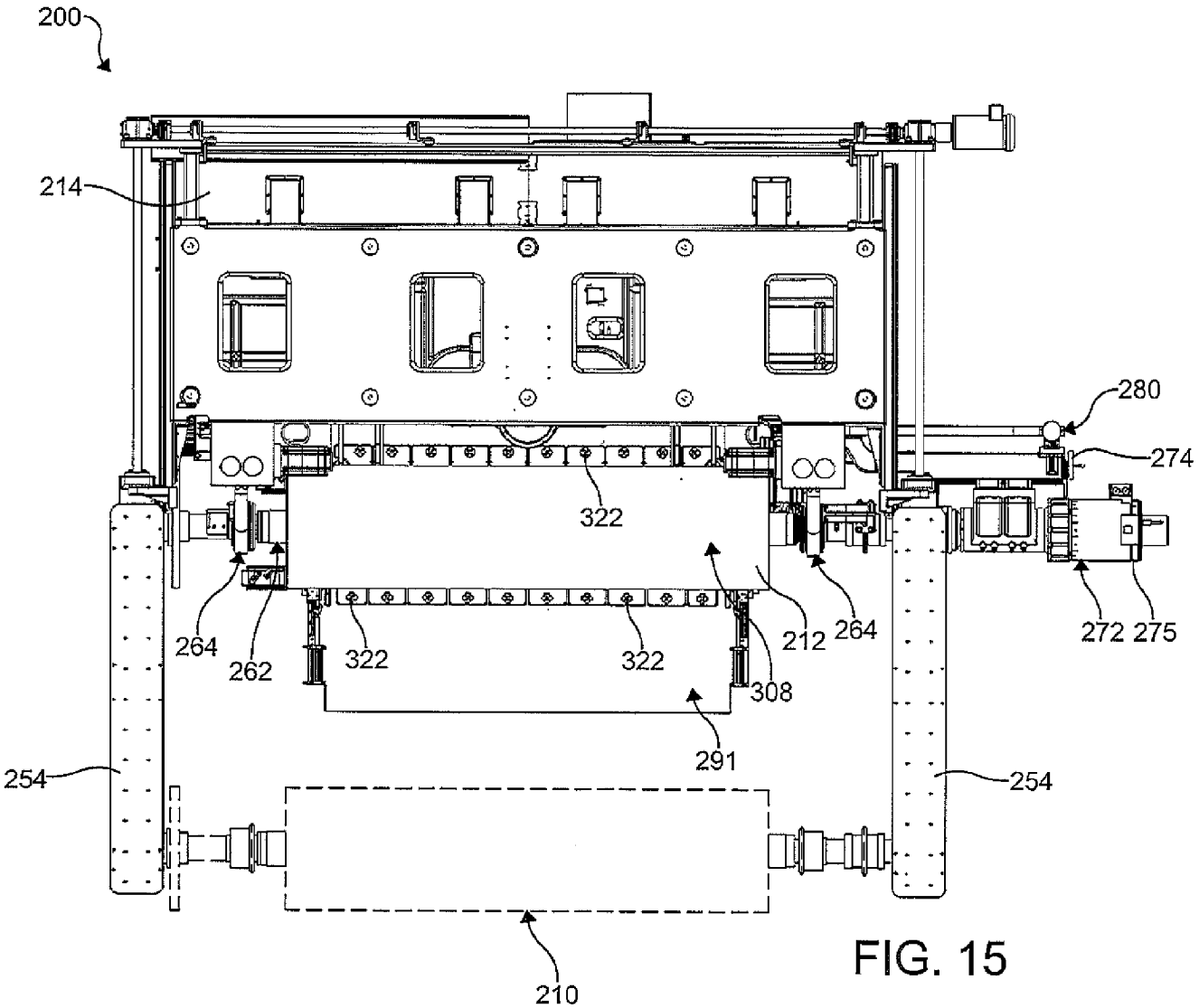
FIG. 15 is a bottom plan view of the apparatus illustrated in FIGS. 12-14.

As illustrated in solid line in FIGS. 12 and 15, the first end 258 of the axle 262 cooperates with a positioning assembly 272. The positioning assembly 272 shown includes an adapter 273 for receiving the first end 258 of the axle 262 therein. The adapter 273 of the positioning assembly 272 can be engaged to locate the printing cylinder 212 in a desired position and maintain the desired position during operation of the apparatus 200. Conversely, the adapter 273 of the positioning assembly 272 can be disengaged to allow the printing cylinder 212 to be inserted, removed, or replaced. In the embodiment shown, the adapter 273 is manually positioned onto the first end 258 of the printing cylinder 212 using an actuator 274 (i.e. a hand wheel), shown in FIGS. 13-14. It is understood that the adapter 273 can be automatically positioned onto the printing cylinder 212 if desired. The adapter 273 of the positioning assembly 272 facilitates a rotational movement of the printing cylinder 212 in at least one of a first or clockwise direction and an opposite second or counter-clockwise direction. At least one actuator 275 can be employed to cause the rotational movement of the printing cylinder 212. It is understood that the actuator 275 can be any suitable actuator such as a mechanical, an electrical, or an electro-mechanical actuator, for example.

In certain embodiments, the positioning assembly 272 is movably mounted on tracks or rails 276, 278 coupled to a first support assembly 280. It is understood, however, that the positioning assembly 272 can be movably mounted to the first support assembly 280 by any means as desired. The rails 276 permit movement of the positioning assembly 272 along an "X" axis of the apparatus 200 for engagement and disengagement of the adapter 273 with the axle 262 of the printing cylinder 212. The "X" axis of the apparatus 200 extends generally perpendicular to a plane of FIGS. 13-14. The rails 278 permit movement of the positioning assembly 272 along with the printing cylinder 212 along the "Z" axis of the apparatus 200 for the positioning of the printing cylinder 212 between a first or downward position and a second or upward position.

Figure 16:
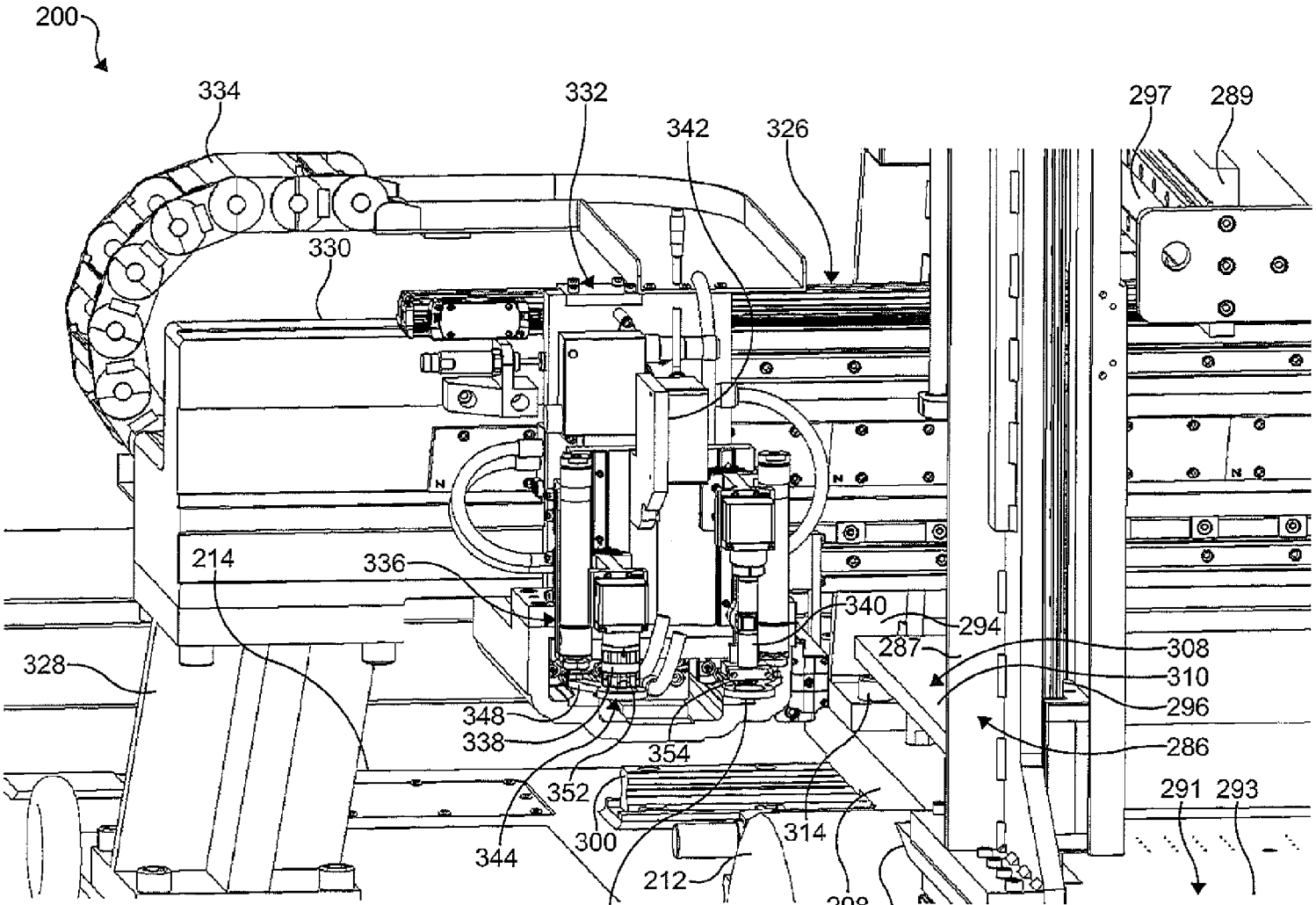
FIG. 16 is an enlarged fragmentary front perspective view of a portion of the apparatus shown within circle 15 of FIG. 12 having a pair of holding devices in a first or retracted position.

A support assembly 286 is positioned at a front of the apparatus 200. The support assembly 286 shown includes a pair of corresponding spaced apart, generally 90-degree legs 289 having a cross-member 290 extending therebetween. The legs 289 are coupled at a rear of the base 214 on opposite sides of the apparatus 200 to support a pair of spaced apart, generally vertically extending legs 287 having a cross-member 288 extending therebetween. The legs 287 are positioned at opposite sides of the apparatus 200 to support a first table 291. The table 291 has a generally horizontal and substantially planar top surface 292. A rear edge 294 of the table 291 is beveled to permit the table 291 to be positioned adjacent the printing cylinder 212, as shown in FIGS. 12, 14, and 16. It is understood that the table 291 can be any size and shape as desired.

The table 291 extends across a front of the apparatus 200 along the "X" axis thereof. In certain embodiments, the table 291 is movably mounted on tracks or rails 296 (shown in FIG. 16) coupled to the legs 287. It is understood that the table 291 can be movably mounted to the legs 287 by any means as desired. The rails 296 permit movement of the table 291 along the "Z" axis of the apparatus 200. In certain embodiments, each of the legs 287 of the support assembly 286 is movably mounted on tracks or rails 297 (shown in FIGS. 12-14 and 16) coupled to the legs 289. It is understood that each of the legs 287 can be movably mounted to the legs 289 by any means as desired. The rails 297 permit movement of the table 291 along the "Y" axis of the apparatus 200. Accordingly, the table 291 can travel in a first or forward direction and a second or rearward direction along the "Y" axis, as well as a first or upward direction and a second or downward direction along the "Z" axis.

As shown in FIG. 16, each of the legs 289 of the support assembly 286 is coupled to a generally horizontal slideable member 298. In certain embodiments, the slideable member 298 is movably mounted on tracks or rails 300 coupled to the base 214. It is understood that the slideable member 298 can be movably mounted to the base 214 by any means as desired. The rails 300 permit movement of the slideable member 298 along the "X" axis of the apparatus 200. Accordingly, the slideable member 298, the support assembly 286, and the table 291 can travel in a first or leftward direction and a second or rightward direction along the "X" axis.

At least one actuator 302 can be employed to cause the movement of the slideable member 298, the legs 287, and the table 291. It is understood that the actuator 302 can be any suitable actuator such as a mechanical, an electrical, or an electro-mechanical actuator, for example.

A roller 304 is rotatably supported at its ends by a pair of spaced apart arms 306. A lower portion of the arms 306 is slideably coupled to a bottom surface of the table 291. Each of the arms 306 extends through a respective slot (not shown) formed in the table 291. The slots permit movement of the roller 304 in a first or forward direction and a second or rearward direction along the "Y" axis of the apparatus 200. The roller 304 is selectively positionable between a first position and a second position. When the roller 304 is at the first position, the roller 304 is adjacent the table 291 offset from the rear edge 294 thereof. Conversely, when the roller 304 is at the second position, the roller 304 is adjacent the printing cylinder 212. At least one actuator can be employed to cause the movement of the roller 304. It is understood that the actuator can be any suitable actuator such as a mechanical, an electrical, or an electro-mechanical actuator, for example. The roller 304 shown has a generally cylindrical shape having a circular cross-section. It is understood, however, that the roller 304 can have any shape and size as desired.

As illustrated in FIGS. 12-14 and 16, a second table 308 is coupled to the slideable member 298. In certain embodiments, the slideable member 298 is movably mounted on tracks or rails 300 coupled to the base 214. The slideable member 298 permits movement of the table 308 in a first or leftward direction and a second or rightward direction along the "X" axis of the apparatus 200. Accordingly, the table 308 can travel in a first or left direction and a second or right direction along the "X" axis. The table 308 is generally rectangular and has a substantially horizontal and planar top surface 310. A front edge 312 of the table 308 is beveled to permit the table 308 to be positioned adjacent the printing cylinder 212. It is understood that the table 308 can be any size and shape as desired. As shown, the table 308 extends across the top of the base 214 of the apparatus 200 substantially coplanar with and opposite the table 308 forming a space therebetween. In certain embodiments, the table 308 is movably mounted on bearings 314 coupled to the base 214. At least one wear plate (not shown) may be disposed in a bottom surface of the table 308 adjacent the bearings 314 to militate against damage to the table 308 by the bearings 314. In the embodiment shown, the bearings 314 permit movement of the table 308 along the "X" axis of the apparatus 200. It is understood that the bearings 314 can also permit a rotational movement of the table 308.

Figure 13:
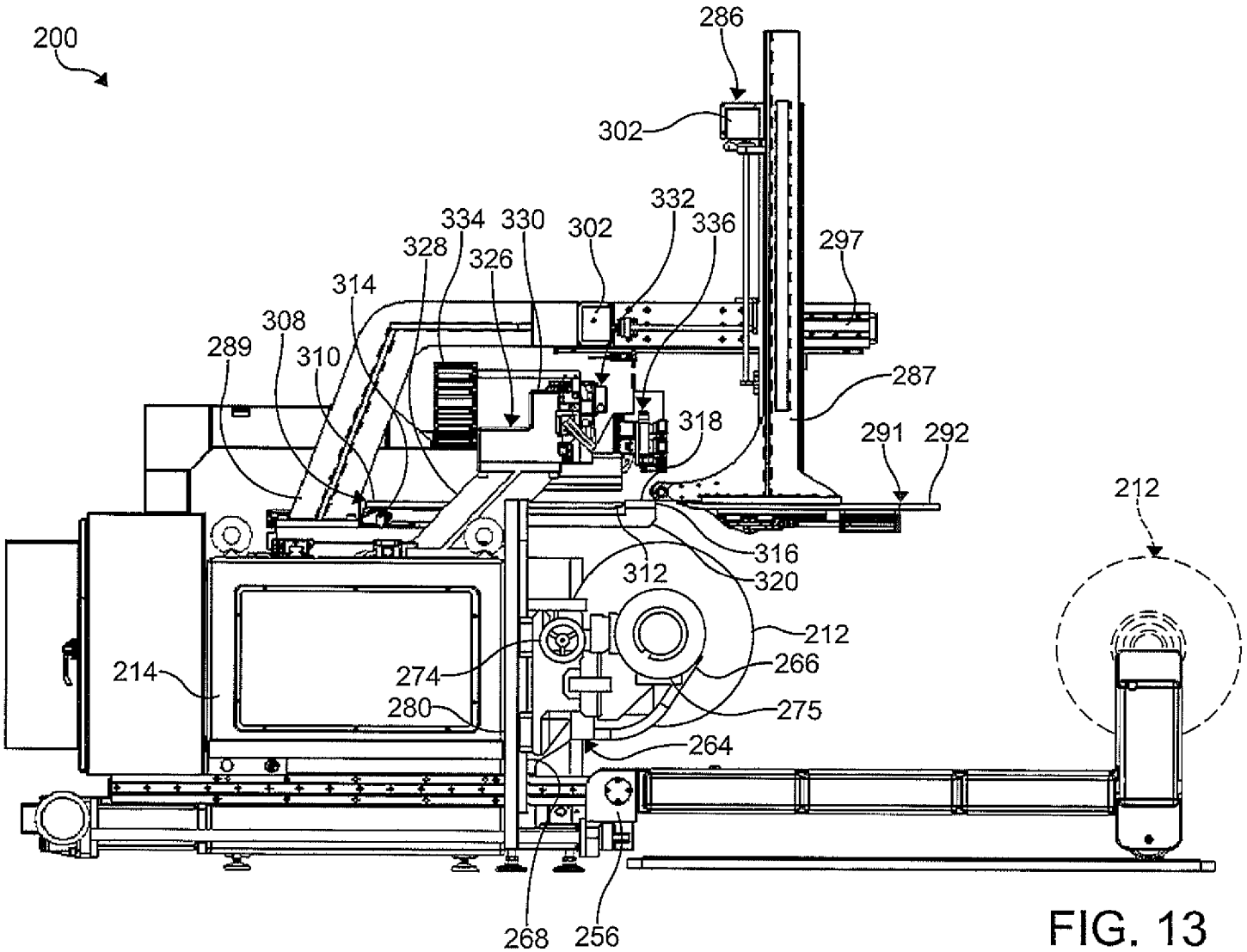
FIG. 13 is a left side elevational view of the apparatus illustrated in FIG. 12 showing the forward position of a printing cylinder in dashed line and the rearward position thereof in solid line.

As illustrated in FIG. 13, a third table 316 is disposed in the space formed between the tables 291, 308, 316. The table 316 is generally rectangular and has a substantially horizontal and planar top surface 318. It is understood that the table 316 can be any size and shape as desired. The table 316 is supported at its ends by a pair of spaced apart arms 320. A lower portion of the arms 320 is slideably coupled to the top surface of the base 214. The arms 320 permit movement of the table 316 in a first or forward direction and a second or rearward direction along the "Y" axis of the apparatus. The table 316 is selectively positionable between a first position and a second position. When the table 316 is at the first position, the table 316 is positioned in between the tables 291, 308. Conversely, when the table 316 is at the second position, the table 316 is underneath the table 308 to open the space between the tables 291, 308. At least one actuator can be employed to cause the movement of the table 316. It is understood that the actuator can be any suitable actuator such as a mechanical, an electrical, or an electro-mechanical actuator, for example.

Each of the tables 291, 308, 316 may be provided with a plurality of slits (not shown) in fluid communication with a plurality of ports 322 shown in FIG. 15. The port 322 is coupled to a source of vacuum through a conduit (not shown). When the printing plate 11 is placed on the top surfaces 292, 310, 318 of the respective tables 291, 308, 316, a vacuum is applied to the printing plate 11, thereby firmly holding the printing plate 11 to militate against a movement thereof relative to the tables 291, 308, 316. It is understood that a plurality of vacuum zones can be produced by selectively controlling the vacuum through at least one the ports 322. The vacuum zones can be controlled, individually or in combination, to apply the vacuum to the printing plate 11.

A third carrier 326 is positioned at a top of the apparatus 200 and includes a pair of generally vertically extending legs 328. The legs 328 are positioned at opposite sides of the apparatus 200 to support a bridge member 330. The third carrier 326 is fixedly coupled to the base 214. Mounted on the bridge member 330 is an instrument carriage 332. The instrument carriage 332 is moveable in respect of the bridge member 330 along the "X" axis of the apparatus 200. At least one actuator 334 can be employed to cause the movement of the instrument carriage 332. It is understood that the actuator 334 can be any suitable actuator such as a mechanical, an electrical, or an electro-mechanical actuator, for example.

An optical system 336 is mounted on the instrument carriage 332. The optical system 336 includes a first camera 338, a second camera 340, and a reader head 342 emitting a light beam. The cameras 338, 340 and the reader head 342 are directed downwardly toward at least one of the top surfaces 292, 310, 318 of the respective tables 291, 308, 316. It is understood that the cameras 338, 340 can be any suitable cameras and the reader head 342 can be any suitable reader head such as an optical digital micrometer or a displacement measuring laser, for example. In certain embodiments, each of the cameras 338, 340 is movably mounted on tracks or rails 343 coupled to the instrument carriage 332. The rails 343 permit distinct movement of each of the cameras 338, 340 in a first or forward direction and a second or rearward direction along the "Y" axis of the apparatus 200. In a non-limiting example, the rails 343 permit distinct movement of each of the cameras 338, 340 in the forward direction in a range of about 0-2 inches along the "Y" axis of the apparatus 200 and in the rearward direction in a range of about 0-2 inches along the "Y" axis of the apparatus 200.

The first camera 338 has a wide angle lens to provide a wider angle of view than an angle of view of the second camera 340. As shown in FIG. 16, the instrument carriage 332 further includes a first holding device 344 coupled to the first camera 338 and a second holding device 346 coupled to the second camera 340. Each of the holding devices 344, 346 is positionable between a first or retracted position, shown in FIG. 16, and a second or extended position (not shown). In the extended position, foot portions 348, 350 of the respective holding devices 344, 346 contact an upper surface of the printing plate 11. The foot portions 348, 350 each includes a respective central aperture 352, 354 formed therein to permit the cameras 338, 340 to view the registration marks 13*a*, 13*b* on the printing plate 11.

The apparatus 200 further includes a control system (not shown). The control system includes a programmable controller (not shown) connected to control all of the actuators, the cameras 338, 340, and the reader head 342. Thus, the controller generates control signals to control movement of the tables 291, 308, 316, the roller 304, the positioning assembly 272, the first carriers 250, the second carriers 264, the third carrier 326, the instrument carriage 332, the cameras 338, 340, the reader head 342, and the printing cylinder 212. The control system further includes a user interface such as a touch screen, for example, in electrical communication with the controller. The user interface permits the user to enter inputs such as a location of the registration marks 13*a*, 13*b* of the printing plate 11, a zoom command, a size of the printing cylinder 212, and the like, for example. It is understood that the user can enter the input using any input device as desired such as by a touch panel, a keyboard, a mouse, a joystick, or the like, for example.

A method of operation of the apparatus 200 includes loading the printing cylinder 212 into the first carriers 250 such that the ends 258, 260 of the axle 262 are retained therein. The first carriers 250 are then caused to move along the "Y" axis of the apparatus 200 in a rearward direction from the first position to the second position. Thereafter, the arms 266 of the second carriers 264 receive a portion of the axle 262 thereon and rotatably support the printing cylinder 212. The positioning assembly 272 is then engaged to locate the printing cylinder 212 in a desired position and maintain the desired position during operation of the apparatus 200. Specifically, the adapter 273 of the positioning assembly 272 is removably coupled to the first end 258 of the axle 262. Once the printing cylinder 212 is loaded in the apparatus 200, the controller of the control system verifies the printing cylinder 212, the radial position of the printing cylinder 212, and the size thereof using a measuring ability of the reader head 342 or the proxy or sensor disposed in the arm 266.

The third table 316 is then positioned in the space between the first table 291 and the second table 308. Thereafter, the roller 304 is moved in a forward direction to the first position. The printing plate 11 is then located by the user on at least one of the tables 291, 308, 316 such that the first registration mark 13*a* of the printing plate 11 is substantially aligned with a light beam emitted from the reader head 342 and the second registration mark 13*b* is as close to aligned with the first registration mark 13*a* with respect to the "X" axis of the apparatus 200. A vacuum is then applied to the printing plate 11 to secure the printing plate 11 to the at least one of the tables 291, 308, 316.

The first holding device 344 is then positioned in the extended position having the first foot portion 348 contact the printing plate 11. The first camera 338 transmits a signal to the controller and a wide angle view of the first registration mark 13*a* is displayed on the user interface. The user then selects a desired location point of the first registration mark 13*a* displayed on the user interface. It is understood that the user can select the desired location point of the first registration mark 13*a* using any input device as desired such as a touch panel, a keyboard, a mouse, a joystick, or the like, for example. Once the desired location point is selected, the first holding device 344 is positioned in the retracted position.

The instrument carriage 332 is then caused to move along the "X" axis of the apparatus 200 such that the second camera 340 is positioned directly above the first registration mark 13*a*. In certain embodiments, the second camera 340 can move along the "Y" axis of the apparatus 200 for positioning directly above the first registration mark 13*a*. The second holding device 346 is then positioned in the extended position having the second foot portion 350 contact the printing plate 11. The second camera 340 transmits a signal to the controller and a close-up view of the first registration mark 13*a* is displayed on the user interface. The user then selects a desired location point of the first registration mark 13*a* displayed on the user interface. It is understood that the user can select the desired location point of the first registration mark 13*a* using any input device as desired such as a touch panel, a keyboard, a mouse, a joystick, or the like, for example. Once the desired location point is selected, the second holding device 346 is positioned in the retracted position.

The instrument carriage 332 is then caused to move along the "X" axis of the apparatus 200 such that the first camera 338 is directly above the second registration mark 13*b*. In certain embodiments, the first camera 338 can move along the "Y" axis of the apparatus 200 for positioning directly above the second registration mark 13*b*. The first holding device 344 is then positioned in the extended position having the first foot portion 348 contact the printing plate 11. The first camera 338 transmits a signal to the controller and a wide angle view of the second registration mark 13*b* is displayed on the user interface. The user then selects a desired location point of the second registration mark 13*b* displayed on the user interface.

It is understood that the user can select the desired location point of the second registration mark 13*b* using any input device as desired such as a touch panel, a keyboard, a mouse, a joystick, or the like, for example. The user can repeat the step of selecting the desired location point of the second registration mark 13*b* displayed on the user interface until a desired location of the desired location point is selected. Once the desired location of the desired location point of the second registration mark 13*b* is selected, the first holding device 344 is positioned in the retracted position.

The instrument carriage 332 is then caused to move along the "X" axis of the apparatus 200 such that the second camera 340 is directly above the second registration mark 13*b*. In certain embodiments, the second camera 340 can move along the "Y" axis of the apparatus 200 for positioning directly above the second registration mark 13*b*. The second holding device 346 is then positioned in the extended position having the second foot portion 350 contact the printing plate 11. The second camera 340 transmits a signal to the controller and a close-up view of the second registration mark 13*b* is displayed on the user interface. The user then selects a desired location point of the second registration mark 13*b* displayed on the user interface. It is understood that the user can select the desired location point of the second registration mark 13*b* using any input device as desired such as a touch panel, a keyboard, a mouse, a joystick, or the like, for example. The user can repeat the step of selecting the desired location point of the second registration mark 13*b* displayed on the user interface until a desired location of the desired location point is selected. Once the desired location of the desired location point of the second registration mark 13*b* is selected, the second holding device 346 is positioned in the retracted position.

Once the desired location points of the registration marks 13*a*, 13*b* are selected by the user using the user interface, the printing plate 11 is aligned in respect of the printing cylinder 212. In certain embodiments, the printing plate 11 is aligned by a rotational movement and/or axial movement of the table 308 along the "X" axis and the "Y" axis of the apparatus 200 such that the registration marks 13*a*, 13*b* are substantially parallel to a central axis of the printing cylinder 212.

Once the printing plate 11 is aligned in respect of the printing cylinder 212, the instrument carriage 332 is then caused to move along the "X" axis of the apparatus 200 such that the second camera 340 is directly above the first registration mark 13*a*. In certain embodiments, the second camera 340 can move along the "Y" axis of the apparatus 200 for positioning directly above the first registration mark 13*a*. The second holding device 346 is then positioned in the extended position having the second foot portion 350 contact the printing plate 11. The second camera 340 transmits a signal to the controller and a close-up view of the first registration mark 13*a* is displayed on the user interface. The user then checks the location of the desired location point of the first registration mark 13*a* displayed on the user interface. The user then selects the desired location point of the first registration mark 13*a* displayed on the user interface. Once the desired location of the desired location point of the first registration mark 13*a* is selected, the second holding device 344 is positioned in the retracted position.

The instrument carriage 332 is then caused to move along the "X" axis of the apparatus 200 such that the second camera 340 is directly above the second registration mark 13*b*. In certain embodiments, the second camera 340 can move along the "Y" axis of the apparatus 200 for positioning directly above the second registration mark 13*b*. The second holding device 346 is then positioned in the extended position having the second foot portion 350 contact the printing plate 11. The second camera 340 transmits a signal to the controller and a close-up view of the second registration mark 13*b* is displayed on the user interface. The user then checks the location of the desired location point of the second registration mark 13*b* displayed on the user interface. The user then selects a desired location point of the second registration mark 13*b* displayed on the user interface. Once the desired location of the desired location point of the second registration mark 13*b* is selected, the second holding device 346 is positioned in the retracted position. The controller than calculates a variance in an alignment of the registration marks 13*a*, 13*b* in an "X" direction and a "Y" direction with respect to the central axis of the printing cylinder 212. The variance in the alignment of the registration marks 13*a*, 13*b* in the "X" direction and the "Y" direction are displayed on the user interface to permit the user to determine whether the printing plate 11 was suitably aligned in respect of the printing cylinder 212.

If the printing plate 11 was not suitably aligned, the user can repeat the above steps of selecting the desired location point of the registration marks 13*a*, 13*b* and aligning the printing plate 11 until a desired alignment of the printing plate 11 is obtained.

Once the printing plate 11 is suitably aligned in respect of the printing cylinder 212, the table 316 is then caused to be moved to expose the space between the tables 291, 308. The second carriers 264 are then caused to move along the "Z" axis of the apparatus 200 in an upward direction until the printing cylinder 212 contacts the printing plate 11. Once the printing cylinder 212 contacts the printing plate 11, the roller 304 is caused to move from the first position to the second position adjacent an apex of the printing cylinder 212.

The roller 304 contacts the printing plate 11 to cause a central portion of the printing plate 11 to adhere to the printing cylinder 212. The roller 304 and the table 291 are then caused to move in a substantially arcuate path around a circumference of the printing cylinder 212 to a leading edge of the printing plate 11, thereby causing a first half of the printing plate 11 to adhere to the printing cylinder 212. The roller 304 and the table 291 are then caused to move away from the printing cylinder 212 and return to a position where the roller 304 is in contact with the central portion of the printing plate 11 adhered to the printing cylinder 212. The printing cylinder 212 then rotates in the first direction, thereby causing the second half of the printing plate 11 to adhere to the printing cylinder 212. Once the complete printing plate 11 is adhered to the printing cylinder 212, the table 291 and the roller 304 are positioned away from the printing cylinder 212. Thereafter, the printing cylinder 212 is rotated in the second direction until the registration marks 13*a*, 13*b* are located at the apex of the printing cylinder 212.

Once the registration marks 13*a*, 13*b* are located at the apex of the printing cylinder 212, the instrument carriage 332 moves along the "X" axis of the apparatus 200 such that the second camera 340 is directly above the first registration mark 13*a*. In certain embodiments, the second camera 340 can move along the "Y" axis of the apparatus 200 for positioning directly above the first registration mark 13*a*. The second holding device 346 is then positioned in the extended position having the second foot portion 350 contact the printing plate 11. The second camera 340 transmits a signal to the controller and a close-up view of the first registration mark 13*a* is displayed on the user interface. The user then checks the location of the desired location point of the first registration mark 13*a* displayed on the user interface. The user then selects a desired location point of the first registration mark

13*a* displayed on the user interface. Once the desired location point is selected, the second holding device 346 is positioned in the retracted position.

The instrument carriage 332 is then caused to move along the "X" axis of the apparatus 200 such that the second camera 340 is directly above the second registration mark 13*b*. In certain embodiments, the second camera 340 can move along the "Y" axis of the apparatus 200 for positioning directly above the second registration mark 13*b*. The user then checks the location of the desired location point of the second registration mark 13*b* displayed on the user interface. The user then selects a desired location point of the second registration mark 13*b* displayed on the user interface. Once the desired location point is selected, the second holding device 350 is positioned in the retracted position. The controller then calculates a variance in an alignment of the registration marks 13*a*, 13*b* in an "X" direction and a "Y" direction with respect to the central axis of the printing cylinder 212. The variance in the alignment of the registration marks 13*a*, 13*b* in the "X" direction and the "Y" direction are displayed on the user interface to permit the user to determine whether the printing plate 11 was suitably mounted on the printing cylinder 212.

The steps described hereinabove can be repeated for additional printing plates 11 if desired or to realign the printing plate 11 already mounted on the printing cylinder 212. When a mounting of the printing plates 11 is complete, the printing cylinder 212 is moved along the "Z" axis of the apparatus 200 in a downward direction to the first position to be removed and/or replaced. Thereafter, the positioning assembly 272 is disengaged from the printing cylinder 212. Specifically, the adapter 273 of the positioning assembly 242 releases and moves away from the first end 258 of the axle 262. Thereafter, the printing cylinder 212 having the desired printing plates 11 disposed thereon is unloaded from the apparatus 200.

The invention is not limited to the embodiments described and represented in the attached drawings. Modifications are still possible, in particular with regard to the configuration of the various elements or substituting equivalent techniques without departing as such from the scope of protection of the invention.

What is claimed is:

1. An apparatus comprising:

a base for supporting a printing cylinder configured to receive at least one flexible printing plate thereon, the printing cylinder having a central axis;

an optical system coupled to the base, the optical system including a first camera and a second camera, the first camera having an angle of view that is wider than an angle of view of the second camera, wherein the optical system transmits images of a plurality of registration marks located on the at least one flexible printing plate to be displayed on the user interface;

at least one holding device coupled to at least one of the first camera and the second camera, the at least one holding device positionable between a retracted position and an extended position, a foot portion of the holding device configured to contact the flexible printing plate in the extended position; and a control system coupled to the base, the control system having a user interface and in communication with the optical system, wherein the control system receives from the optical system transmitted images of the plurality of registration marks located on the at least one flexible printing plate to be displayed on the user interface, and wherein a desired location point of each of the registration marks displayed with the images on the user interface is selectable by a user to facilitate an alignment of the at least one flexible printing plate in respect of the central axis of the printing cylinder.

2. The apparatus according to claim 1, further comprising a first table movably coupled to the base, wherein a movement of the first table facilities a mounting of the at least one flexible printing plate onto the printing cylinder.

3. The apparatus according to claim 2, further comprising a second table movably coupled to the base, wherein a movement of the second table aligns the at least one flexible printing plate in respect of the central axis of the printing cylinder.

4. The apparatus according to claim 3, further comprising a third table movably coupled to the base to provide support to the at least one flexible printing plate during the alignment thereof.

5. The apparatus according to claim 1, further comprising a positioning system for positioning and maintaining the printing cylinder in a desired position.

6. The apparatus according to claim 1, wherein the optical system further includes a reader head.

7. The apparatus according to claim 1, wherein the optical system is movably coupled to a support assembly to facilitate a movement of the optical system along at least one axis of the apparatus.

8. The apparatus according to claim 1, wherein the registration marks are located along opposing edges of the at least one flexible printing plate.

9. The apparatus of claim 1, wherein the foot portion has an aperture permitting one of the first camera and the second camera to view ones of the registration marks therethrough.

10. A method comprising the steps of:

providing an apparatus having a base for supporting a printing cylinder configured to receive at least one flexible printing plate thereon, the printing cylinder having a central axis, an optical system coupled to the base, the optical system including a first camera and a second camera, the first camera having an angle of view that is wider than an angle of view of the second camera, wherein the optical system transmits images of a plurality of registration marks located on the at least one flexible printing plate to be displayed on the user interface, at least one holding device coupled to at least one of the first camera and the second camera, the at least one holding device positionable between a retracted position and an extended position, a foot portion of the holding device configured to contact the flexible printing plate in the extended position, and a control system coupled to the base, the control system having a user interface and in communication with the optical system, wherein the control system receives from the optical system transmitted images of the plurality of registration marks located on the at least one flexible printing plate to be displayed on the user interface, and wherein a desired location point of each of the registration marks displayed with the images on the user interface is selectable by a user to facilitate an alignment of the at least one flexible printing plate in respect of the central axis of the printing cylinder;

selecting the desired location point of each of the registration marks displayed from the images on the user interface;

calculating a variance in an alignment of the registration marks in an "X" direction and a "Y" direction with respect to the central axis of the printing cylinder using the control system and displaying the calculated variance on the user interface to confirm that the printing plate is aligned with respect to the printing cylinder; and aligning the at least one flexible printing plate in respect of the central axis of the printing cylinder based upon the desired location points of the registration marks and the calculated variance.

11. The method according to claim 10, wherein the registration marks are located along opposing edges of the at least one flexible printing plate.

12. The method according to claim 10, further comprising the step of providing at least one table to facilitate the step of aligning the at least one flexible printing plate in respect of the central axis of the printing cylinder.

13. The method according to claim 10, further comprising the steps of:

mounting a first portion of the at least one flexible printing plate onto the printing cylinder; and mounting a second portion of the at least one flexible printing plate onto the printing cylinder.

14. The method of claim 10, wherein the foot portion has an aperture permitting one of the first camera and the second camera to view ones of the registration marks therethrough.

* * * * *